US007561816B2

(12) United States Patent
Asakura et al.

(10) Patent No.: US 7,561,816 B2
(45) Date of Patent: Jul. 14, 2009

(54) IMAGE HEATING APPARATUS AND IMAGE FORMING APPARATUS INCLUDING SYNCHRONIZATION OF MAGNETIC FLUX GENERATION

(75) Inventors: Kenji Asakura, Kyoto (JP); Noboru Katakabe, Uji (JP); Keisuke Fujimoto, Hirakata (JP); Masaru Imai, Hirakata (JP); Noriyuki Tajima, Hirakata (JP)

(73) Assignee: Panasonic Corporation, Osaka (JP)

( * ) Notice: Subject to any disclaimer, the term of this patent is extended or adjusted under 35 U.S.C. 154(b) by 316 days.

(21) Appl. No.: 10/542,006

(22) PCT Filed: Jan. 14, 2004

(86) PCT No.: PCT/JP2004/000169

§ 371 (c)(1),
(2), (4) Date: Jul. 12, 2005

(87) PCT Pub. No.: WO2004/063820

PCT Pub. Date: Jul. 29, 2004

(65) Prior Publication Data

US 2006/0099001 A1 May 11, 2006

(30) Foreign Application Priority Data

Jan. 14, 2004 (JP) ..... 2003-005692

(51) Int. Cl.
*G03G 15/20* (2006.01)

(52) U.S. Cl. ..... 399/69

(58) Field of Classification Search ..... 399/69, 399/328

See application file for complete search history.

(56) References Cited

U.S. PATENT DOCUMENTS

| | | | | |
|---|---|---|---|---|
| 2002/0158063 | A1* | 10/2002 | Kawase | 219/619 |
| 2003/0086736 | A1* | 5/2003 | Sekiguchi et al. | 399/328 |
| 2004/0253027 | A1* | 12/2004 | Kato et al. | 399/328 |

FOREIGN PATENT DOCUMENTS

| | | |
|---|---|---|
| JP | 2-262177 | 10/1990 |
| JP | 5-135848 | 6/1993 |
| JP | 9-171889 | 6/1997 |
| JP | 10-74009 | 3/1998 |
| JP | 2000-181258 | 6/2000 |
| JP | 2001-125407 | 5/2001 |

OTHER PUBLICATIONS

English language Abstract of JP 10-74009, Mar. 17, 1998.
English language Abstract of JP 2001-125407, May 11, 2001.
English language Abstract of JP 2000-181258, Jun. 30, 2000.
English language Abstract of JP 9-171889, Jun. 30, 1997.
English language Abstract of JP 5-135848, Jun. 1, 1993.
English language Abstract of JP 2-262177, Oct. 24, 1990.

* cited by examiner

*Primary Examiner*—Quana M Grainger
(74) *Attorney, Agent, or Firm*—Greenblum & Bernstein, P.L.C.

(57) ABSTRACT

A fixing unit is provided with a fixing belt that heats recording paper that bears and moves a toner image, an exciting coil that generates magnetic flux in the fixing belt and causes the fixing belt to produce heat by electromagnetic induction, and a heat production adjustment section that adjusts the calorific value distribution of the fixing belt by adjusting the magnetic flux acting upon the fixing belt.

24 Claims, 17 Drawing Sheets

IMAGE HEATING APPARATUS AND IMAGE FORMING APPARATUS INCLUDING SYNCHRONIZATION OF MAGNETIC FLUX GENERATION

TECHNICAL FIELD

The present invention relates to an image heating apparatus using an electromagnetic induction heating method for fixing an unfixed image, and an image forming apparatus such as an electrophotographic apparatus or electrostatographic apparatus that uses that image heating apparatus.

BACKGROUND ART

An induction heating (IH) type of image heating apparatus generates an eddy current through the action of a magnetic field generated by a magnetic field generation section upon a heat-producing medium. This image heating apparatus heat-fixes an unfixed image on recording paper such as transfer paper or an OHP sheet through Joule heating of the heat-producing medium by means of the eddy current.

This induction heating type of image heating apparatus can selectively heat only the heat-producing medium as compared with a heat roller type of image heating apparatus that uses a halogen lamp as a heat source, and therefore has the advantage of enabling heat production efficiency to be increased and the image heating apparatus startup time to be shortened.

It is desirable to use a thin heat-producing medium comprising a thin sleeve or endless belt as the heat-producing medium of this kind of image heating apparatus. That is to say, a thin heat-producing medium has low thermal capacity and can be made to produce heat in a short time. Therefore, an image heating apparatus that uses a thin heat-producing medium makes possible a marked improvement in startup responsiveness until heat production up to a predetermined heating temperature.

On the other hand, a heat-producing medium of low thermal capacity is prone to absorption of heat through the passage of recording paper and a drop in the temperature of the paper passage area.

Therefore, in an image forming apparatus using a thin heat-producing medium of this kind, the heat-producing medium is heated in a timely fashion to prevent the temperature of the heat-producing medium from falling below the predetermined heating temperature due to the passage of recording paper.

However, with an image heating apparatus that has this kind of configuration, if narrow recording paper is fed through continuously, the heat-producing medium that should suppress a drop in the temperature of the paper passage area is continually heated. Consequently, with this image heating apparatus, a paper non-passage area of the heat-producing medium may be subjected to an excessive rise in temperature.

The image heating apparatus disclosed in Unexamined Japanese Patent Publication No. HEI 10-74009 is known as an example of an image heating apparatus that eliminates this kind of rise in temperature of a paper non-passage area of the heat-producing medium.

FIG. 1 is an oblique drawing of an image heating apparatus disclosed in Unexamined Japanese Patent Publication No. HEI 10-74009.

As shown in FIG. 1, this image heating apparatus is equipped with a metal sleeve 1 as the above-described heat-producing medium that produces heat by means of induction heating, and a pressure roller 2 that exerts pressure on metal sleeve 1. Metal sleeve 1 is mounted on, and supported in a rotatable fashion by, the outer periphery of a cylindrical guide 7. A nip area (pressure area) through which recording paper 8 passes is formed between pressure roller 2 and metal sleeve 1 by the pressure of pressure roller 2 on metal sleeve 1.

This image heating apparatus is also equipped with an exciting coil 4 that generates a high-frequency magnetic field, and magnetic flux absorption members 6*a* and 6*b* that absorb magnetic flux. Exciting coil 4 is installed inside guide 7. Magnetic flux absorption members 6*a* and 6*b* are located on the outside of metal sleeve 1.

In FIG. 1, recording paper 8 bearing an unfixed toner image is transported in the direction indicated by the arrow S and fed into to the nip area. By this means, the unfixed toner image borne on recording paper 8 is heat-fixed onto recording paper 8 by the heat of metal sleeve 1 and the pressure between metal sleeve 1 and pressure roller 2.

In this image heating apparatus, recording paper 8 is basically transported on the right-hand side in FIG. 1, and if the width of recording paper 8 varies, the left-hand side in FIG. 1 is a paper non-passage area.

Magnetic flux absorption member 6*b* located on the left-hand side in FIG. 1 is configured so as to perform parallel movement in the axial direction along a level 5 through rotation of a motor 3.

When wide recording paper 8 is fed into the nip area, this magnetic flux absorption member 6*b* is moved to a position in which it is retracted from the paper passage area of this recording paper 8.

When narrow recording paper 8 is fed into the nip area, magnetic flux absorption member 6*b* is moved to the rear of magnetic flux absorption member 6*a* so as to be positioned in the paper non-passage area of this recording paper 8.

By this means, magnetic flux reaching the paper non-passage area of metal sleeve 1 from exciting coil 4 is absorbed by magnetic flux absorption member 6*b*, and is reduced.

Thus, in this image heating apparatus, by moving magnetic flux absorption member 6*b* according to the width of recording paper 8, magnetic flux arriving from exciting coil 4 is suppressed, and the rise in temperature in the paper non-passage area of metal sleeve 1 is reduced.

However, with this image heating apparatus, in order to perform parallel movement of magnetic flux absorption member 6*b*, the distance between movable magnetic flux absorption member 6*b* and metal sleeve 1 and the distance between magnetic flux absorption member 6*a* and metal sleeve 1 are different, as shown in FIG. 2.

Therefore, in this image heating apparatus, a difference tends to occur between the calorific value of the part of metal sleeve 1 opposite movable magnetic flux absorption member 6*b* and the calorific value of the part of metal sleeve 1 opposite magnetic flux absorption member 6*a*.

Consequently, with this image heating apparatus it is difficult to heat the entire width of metal sleeve 1 uniformly.

FIG. 3 is an oblique drawing of another image heating apparatus disclosed in Unexamined Japanese Patent Publication No. HEI 10-74009. This image heating apparatus uses a magnetic flux masking shield as a means of reducing magnetic flux acting upon metal sleeve 1.

In FIG. 3, a magnetic flux masking shield 9 is positioned so as to be in line with the inner surface of a holder 10 between metal sleeve 1 and exciting coil 4.

When narrow recording paper 8 is passed through, magnetic flux masking shield 9 is moved to a position where it covers exciting coil 4 over an axial direction range equivalent to the paper non-passage area of metal sleeve 1.

On the other hand, when wide recording paper 8 is passed through, magnetic flux masking shield 9 is retracted to the outer edge of the paper passage width of metal sleeve 1.

Thus, in the image heating apparatus shown in FIG. 3, the entire width of metal sleeve 1 is heated uniformly when wide recording paper 8 is passed through.

In this image heating apparatus, since magnetic flux masking shield 9 is installed so as to be in line with the inner surface of holder 10 between metal sleeve 1 and exciting coil 4, magnetic flux masking shield 9 must be made thin.

However, when magnetic flux masking shield 9 is made thin, heat production due to induction heating increases. Moreover, holder 10 is generally made of a plastic material with low thermal conductivity.

Therefore, in the image heating apparatus shown in FIG. 3, there is little heat dissipation from magnetic flux masking shield 9 to holder 10, and there is a danger that magnetic flux masking shield 9 will continue to rise in temperature.

Furthermore, a problem with the image heating apparatuses shown in FIG. 1 and FIG. 3 is that a mechanism is necessary to perform parallel movement of magnetic flux absorption member 6*b* and magnetic flux masking shield 9, making the configuration of the overall apparatus complex and large.

DISCLOSURE OF INVENTION

It is an object of the present invention to provide an image heating apparatus that enables calorific value distribution across the width of a heat-producing medium to be adjusted by means of a simple and inexpensive configuration.

According to one mode of the present invention, an image heating apparatus has a rotatable ring-shaped heat-producing medium that produces heat through the action of magnetic flux; a magnetic flux generation section that is located in proximity to a first peripheral surface of the heat-producing medium and generates magnetic flux that acts upon the heat-producing medium; a magnetic flux adjustment section that is located rotatably in proximity to a second peripheral surface of the heat-producing medium, and has a paper passage area magnetic flux adjustment medium that adjusts magnetic flux acting upon a paper passage area of the heat-producing medium, and a paper non-passage area magnetic flux adjustment medium, with a different rotational phase from the paper passage area magnetic flux adjustment medium, that adjusts magnetic flux acting upon a paper non-passage area of the heat-producing medium; and a synchronization control section that controls the magnetic flux generation timing of the magnetic flux generation section in synchronization with the rotational phases of the magnetic flux adjustment units of the magnetic flux adjustment section.

According to another mode of the present invention, an image heating apparatus has a rotatable ring-shaped heat-producing medium that produces heat through the action of magnetic flux; a magnetic flux generation section that is located in proximity to a first peripheral surface of the heat-producing medium and generates magnetic flux that acts upon the heat-producing medium; a temperature control section that controls the magnetic flux generation section and maintains the temperature of the surface of the heating medium in contact with a heated medium at a predetermined temperature; and a calorific value distribution adjustment section that selectively adjusts magnetic flux acting upon a predetermined area of the heat-producing medium and uniformizes the calorific value distribution of the heat-producing medium.

According to yet another mode of the present invention, an image forming apparatus is equipped with the image heating apparatus according to claim 1; a first temperature sensor that detects the temperature of a paper passage area of the heat-producing medium and sends a heat-producing medium paper passage area detected temperature signal to the temperature control section; and a second temperature sensor that detects the temperature of a paper non-passage area of the heat-producing medium and sends a heat-producing medium paper non-passage area detected temperature signal to the temperature control section; wherein the synchronization control section controls the magnetic flux generation timing of the magnetic flux generation section in synchronization with the rotational phases of the magnetic flux adjustment units of the magnetic flux adjustment section based on a detected temperature signal from the second temperature sensor.

According to a still further mode of the present invention, an image forming apparatus is equipped with the image heating apparatus according to claim 6; a first temperature sensor that detects the temperature of a paper passage area of the heat-producing medium and sends a heat-producing medium paper passage area detected temperature signal to the temperature control section; and a second temperature sensor that detects the temperature of a paper non-passage area of the heat-producing medium and sends a heat-producing medium paper non-passage area detected temperature signal to the temperature control section; wherein the calorific value distribution adjustment section selectively adjusts magnetic flux acting upon a predetermined area of the heat-producing medium and uniformizes the calorific value distribution of the heat-producing medium based on a detected temperature signal from the second temperature sensor.

According to a still further mode of the present invention, an image forming apparatus is equipped with the image heating apparatus according to claim 6; a pressure member that rotates and applies pressure to the heat-producing medium; a third temperature sensor that detects the temperature of a paper passage area of the pressure member and sends a pressure member paper passage area detected temperature signal to the temperature control section; and a fourth temperature sensor that detects the temperature of a paper non-passage area of the pressure member and sends a pressure member paper non-passage area detected temperature signal to the temperature control section; wherein the calorific value distribution adjustment section selectively adjusts magnetic flux acting upon a predetermined area of the heat-producing medium and uniformizes the calorific value distribution of the heat-producing medium based on a detected temperature signal from the fourth temperature sensor.

BEST MODE FOR CARRYING OUT THE INVENTION

Figure 1:
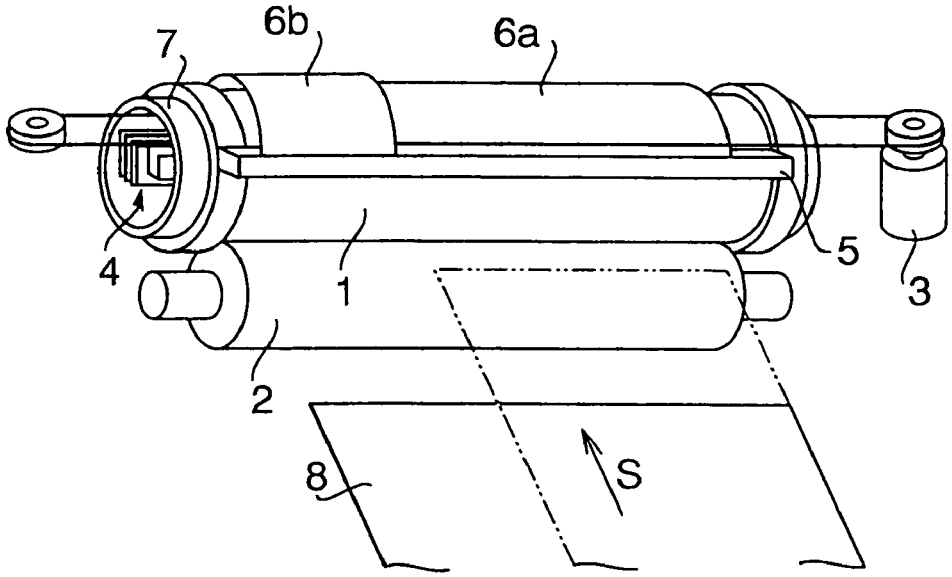
PRIOR ART FIG. 1
FIG. 1 is an oblique drawing showing an example of a conventional image heating apparatus.
Figure 2:
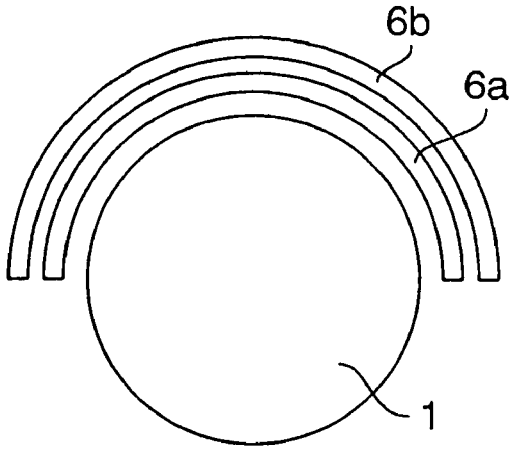
PRIOR ART FIG. 2
FIG. 2 is a side view of a magnetic flux absorption member installed in the image heating apparatus in FIG. 1.
Figure 3:
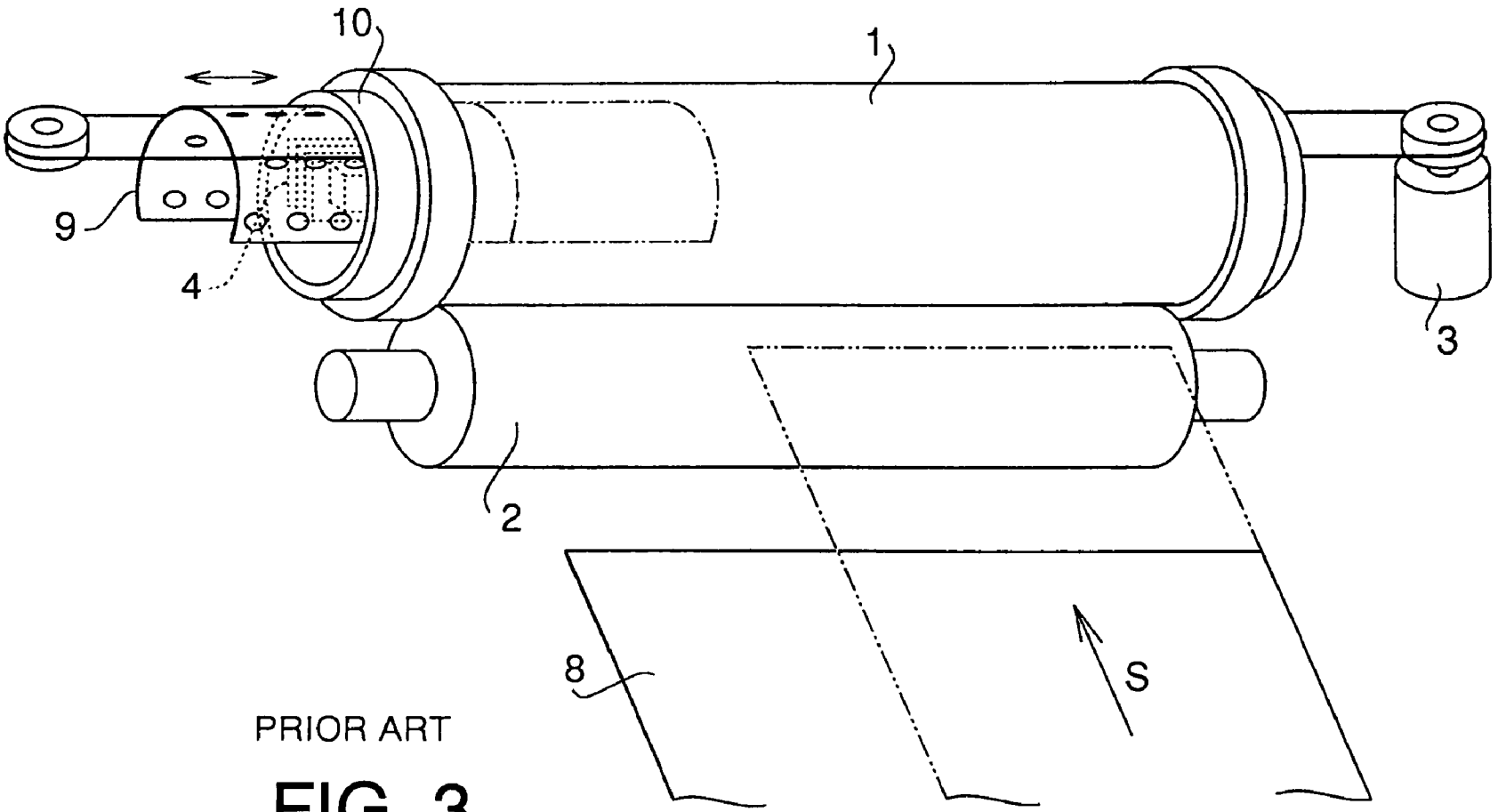
PRIOR ART FIG. 3
FIG. 3 is an oblique drawing showing another example of a conventional image heating apparatus.

An image heating apparatus of the present invention has a configuration equipped with an induction-heated endless heat-producing member that transfers heat directly or indirectly to a heated medium that bears and moves an image; an excitation section that is located opposite the outer peripheral surface of the heat-producing member, and generates magnetic flux and induction-heats the heat-producing member; a temperature control section that controls the excitation section and makes the temperature of a fixing surface that comes into contact with the heated medium a predetermined temperature; a magnetic flux adjustment section that is located rotatably on the opposite side of the heat-producing member from the excitation section, whose electromagnetic characteristics differ in the circumferential direction of the heat-producing member in at least one part of the axial direction of the heat-producing member, and that adjusts magnetic flux acting upon the heat-producing member by means of rotational phase; and a synchronization control section that controls the heating operation mode of the excitation section in synchronization with the rotational phase of the magnetic flux adjustment section.

By this means, with this image heating apparatus the calorific value distribution of the heat-producing member can be adjusted without a mechanical switching operation. Therefore, this image heating apparatus can keep the temperature of the heat-producing member uniform irrespective of the width of the heated medium. By this means, with this image heating apparatus high-quality images can be obtained without reducing throughput even when a wide heated medium and a narrow heated medium are alternately fed through successively.

Also, an image heating apparatus of the present invention has a configuration in which the rotational speed of the magnetic flux adjustment section is different from the rotational speed of the heated heat-producing member.

By this means, with this image heating apparatus it is possible to prevent a calorific value distribution according to differences of electromagnetic characteristics of the magnetic flux adjustment section from directly becoming the calorific value distribution of the heat-producing member. Therefore, this image heating apparatus can reduce calorific value distribution arising in the heat-producing member.

Also, an image heating apparatus of the present invention has a configuration in which the magnetic flux adjustment section rotates an integral number of times while an arbitrary part of the heat-producing member passes through an area opposite the excitation section.

By this means, with this image heating apparatus, a calorific value distribution according to differences of electromagnetic characteristics of the magnetic flux adjustment section can be superimposed in the circumferential direction while the magnetic flux adjustment section passes a heating section. Therefore, this image heating apparatus can make the calorific value distribution arising in the heat-producing member uniform.

Also, an image heating apparatus of the present invention has a configuration in which the direction of rotation of a magnetic flux adjustment section is the reverse of the direction of rotation of a heated heat-producing member.

By this means, with this image heating apparatus, the rotational speed of the magnetic flux adjustment section relative to the heat-producing member can be increased at low rotational speed. Therefore, with this image heating apparatus it is possible to prevent a calorific value distribution according to differences of electromagnetic characteristics of the magnetic flux adjustment section from directly becoming the calorific value distribution of the heat-producing member while suppressing rotation drive noise and rotation drive power of the magnetic flux adjustment section. Thus, this image heating apparatus can reduce calorific value distribution variance arising in the heat-producing member.

Also, an image heating apparatus of the present invention has a configuration in which the downstream end of an area of the magnetic flux adjustment section opposite the excitation member rotates at a speed greater than or equal to movement up to the upstream end on the opposite side while an arbitrary part of the heat-producing member passes through an area opposite the excitation section.

By this means, with this image heating apparatus, a calorific value distribution according to differences of electromagnetic characteristics of the magnetic flux adjustment section can be superimposed in the circumferential direction while the magnetic flux adjustment section passes a heating section. Therefore, this image heating apparatus can make the calorific value distribution arising in the heat-producing member uniform.

Also, an image heating apparatus of the present invention has a configuration in which the magnetic flux adjustment section comprises an opposed core that forms a paper passage area magnetic flux adjustment medium that adjusts the magnetic flux of a paper passage area and a paper non-passage area magnetic flux adjustment medium that adjusts the magnetic flux of a paper non-passage area on the peripheral surface of a cylindrical body.

By this means, with this image heating apparatus the magnetic flux adjustment section can be configured inexpensively and simply.

Also, an image heating apparatus of the present invention has a configuration in which a plurality of aforementioned paper passage area magnetic flux adjustment media are formed on the peripheral surface of the center part of the opposed core, and a plurality of aforementioned paper non-passage area magnetic flux adjustment media are formed on the peripheral surface of both end parts of the opposed core.

By this means, with this image heating apparatus the heat-producing member can be heated to a more accurate temperature. Also, with this image heating apparatus the heat-producing member can be heated more rapidly. Furthermore, with this image heating apparatus it is possible to selectively heat the heat-producing member by making the electromagnetic characteristics of the paper passage area magnetic flux adjustment media and paper non-passage area magnetic flux adjustment media different.

Also, an image heating apparatus of the present invention has a configuration in which the upstream ends of the paper passage area magnetic flux adjustment medium and paper non-passage area magnetic flux adjustment medium are positioned in the center part of the opposed core and the downstream ends of the paper passage area magnetic flux adjustment medium and paper non-passage area magnetic flux adjustment medium are positioned at both ends of the opposed core.

By this means, with this image heating apparatus the width of a paper passage area and a paper non-passage area of the heat-producing member can be set to any width.

Also, an image heating apparatus of the present invention has a configuration in which a plurality of paper passage area magnetic flux adjustment media and paper non-passage area magnetic flux adjustment media are formed alternately in the circumferential direction of the opposed core.

By this means, with this image heating apparatus the width of a paper passage area and a paper non-passage area of the heat-producing member can be set to any width. Also, with this image heating apparatus the heat-producing member can be heated to a more accurate temperature. Furthermore, with this image heating apparatus it is possible to select the heating temperature of the heat-producing member without making the electromagnetic characteristics of the paper passage area magnetic flux adjustment medium and paper non-passage area magnetic flux adjustment medium different.

Also, an image forming apparatus of the present invention has a configuration equipped with an above-described image heating apparatus; a first temperature sensor that is located in a range in which heated media of all applicable widths pass and sends a heat-producing member temperature signal to the temperature control section; and a second temperature sensor that is located in a range in which a heated medium of the minimum applicable width does not pass and at least sends a heat-producing member temperature signal to the heat production adjustment section; wherein the heat production adjustment section controls the heating operation mode of the excitation section and adjusts the calorific value distribution of the heat-producing member based on a signal from the second temperature sensor.

By this means, with this image forming apparatus the temperature of the heat-producing member can be controlled uniformly with a high degree of precision. Therefore, with this image forming apparatus high-quality images can be obtained without reducing throughput even when a wide heated medium and a narrow heated medium are alternately fed through successively.

Also, an image heating apparatus of the present invention has a configuration equipped with an induction-heated endless heat-producing member that transfers heat directly or indirectly to a heated medium that bears and moves an image; an excitation section that is located opposite the heat-producing member, and generates magnetic flux and induction-heats the heat-producing member; a temperature control section that controls the excitation section and makes the temperature of a fixing surface that comes into contact with the heated medium a predetermined temperature; and a heat production adjustment section that adjusts the calorific value distribution of the heat-producing member by adjusting magnetic flux acting upon the heat-producing member; wherein the heat production adjustment section can set at least the calorific value distribution of the heat-producing member, a predetermined calorific value distribution, and a calorific value distribution in which the intensities of the predetermined calorific value distribution are reversed.

By this means, with this image heating apparatus an area for which it is wished to raise the temperature of the heat-producing member can be heated strongly irrespective of the width of the heated medium used. Therefore, this image heating apparatus can keep the temperature of the heat-producing member uniform irrespective of the width of the heated medium. By this means, with this image heating apparatus high-quality images can be obtained without reducing throughput even when a wide heated medium and a narrow heated medium are alternately fed through successively.

Also, an image heating apparatus of the present invention has a configuration in which the heat production adjustment section has a magnetic body that is opposite the excitation section, is made of a magnetic material and has a magnetic property.

By this means, with this image heating apparatus it is possible to improve the magnetic coupling of the excitation section and the heat-producing member, and perform induction heating efficiently.

Also, an image heating apparatus of the present invention has a configuration in which the heat production adjustment section has an electrical conductor that is opposite the excitation section, is made of conductive material and has a conductive property.

By this means, with this image heating apparatus it is possible to suppress magnetic flux leaking externally from the image heating apparatus. Also, with this image heating apparatus, an inexpensive material rather than an expensive high-permeability material can be used for the heat production adjustment section.

Also, an image heating apparatus of the present invention has a configuration in which the heat production adjustment section is equipped with a suppression coil composed of an electrical conductor that is linked to the magnetic flux.

By this means, with this image heating apparatus the calorific value distribution of the heat-producing member can be adjusted without a mechanical switching operation.

Also, an image forming apparatus of the present invention has a configuration equipped with an above-described image heating apparatus; a first temperature sensor that is located in a range in which heated media of all applicable widths pass and sends a heat-producing member temperature signal to the temperature control section; and a second temperature sensor that is located in a range in which a heated medium of the minimum applicable width does not pass and at least sends a heat-producing member temperature signal to the heat production adjustment section; wherein the heat production adjustment section adjusts the calorific value distribution of the heat-producing member based on a signal from the second temperature sensor.

By this means, with this image forming apparatus the temperature of the heat-producing member can be controlled uniformly with a high degree of precision. Therefore, with this image forming apparatus high-quality images can be obtained without reducing throughput even when a wide heated medium and a narrow heated medium are alternately fed through successively.

Also, an image forming apparatus of the present invention has a configuration equipped with an above-described image heating apparatus; a pressure member that feeds the heated medium to the heating member; a first pressure temperature sensor that is located in a paper passage area for heated media of all applicable widths of the pressure member; and a second pressure temperature sensor that is located in a paper non-passage area in which a heated medium of the minimum applicable width does not pass of the pressure section; wherein the heat production adjustment section adjusts the calorific value distribution of the heat-producing member based on signals from the first pressure temperature sensor and the second pressure temperature sensor.

By this means, with this image forming apparatus the temperature of the pressure member can be controlled uniformly irrespective of the width of the heated medium. Therefore, with this image forming apparatus high-quality images can be obtained without reducing throughput even when a wide heated medium and a narrow heated medium are alternately fed through successively.

With reference now to the accompanying drawings, embodiments of the present invention will be explained in detail below. In all the following embodiments, a case is described in which an image heating apparatus of the present invention is used as a fixing unit of an image forming apparatus such as an electrophotographic apparatus or electrostatographic apparatus, for example.

EMBODIMENT 1

Figure 4:
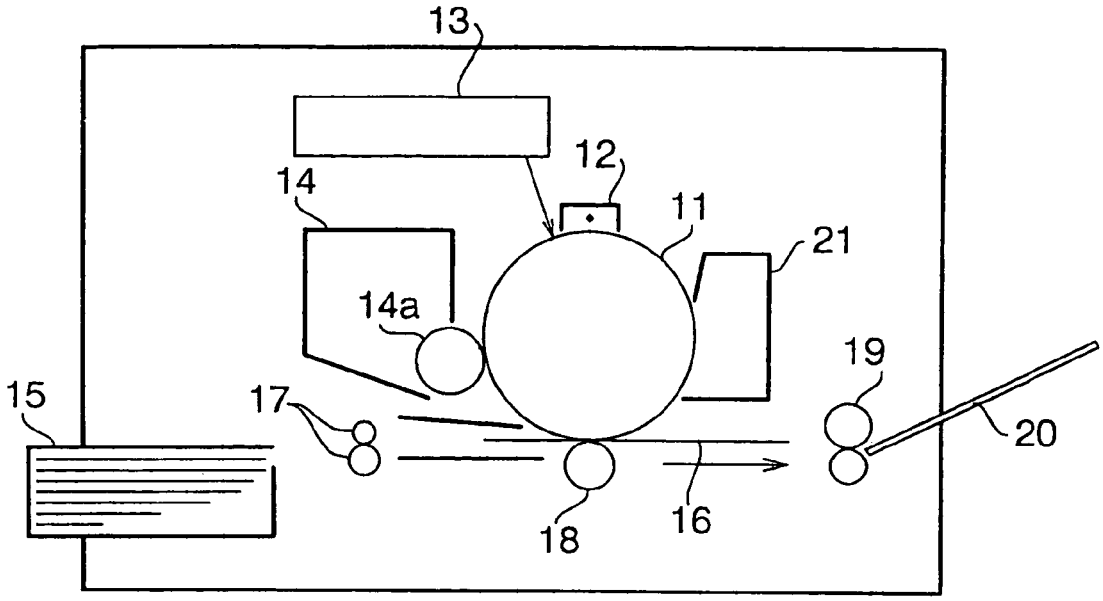
FIG. 4 is a cross-sectional drawing showing an example of the general configuration of an image forming apparatus that uses an image heating apparatus according to Embodiment 1 of the present invention as a fixing unit.

First, a description will be given of the general configuration and operation of the image forming apparatus shown in FIG. 4 that uses a fixing unit according to Embodiment 1 of the present invention. In FIG. 4, an electrophotographic photosensitive body (hereinafter referred to as "photosensitive drum") 11 is rotated at a predetermined peripheral velocity in the direction indicated by the arrow. The surface of photosensitive drum 11 is charged uniformly to a predetermined potential by an electrifier 12.

A laser beam scanner 13 outputs a laser beam modulated in accordance with a time series electrical digital pixel signal of image information input from a host apparatus such as an image reading apparatus or computer (not shown).

This laser beam performs selective scanning exposure of the surface of photosensitive drum 11 uniformly charged as described. By this means, an electrostatic latent image conforming to the image information is formed on the surface of photosensitive drum 11.

This electrostatic latent image is supplied with powdered toner charged by a developing device 14 that has a rotated developing roller 14*a*, and is developed as a toner image.

Meanwhile, recording paper 16 is fed one sheet at a time from a paper feed section 15. Recording paper 16 is transported by a pair of registration rollers 17 at appropriate timing synchronized with the rotation of photosensitive drum 11 to a transfer section composed of photosensitive drum 11 and a transfer roller 18 in contact with photosensitive drum 11.

Through the agency of transfer roller 18 to which a transfer bias voltage is applied, the toner image on photosensitive drum 11 is successively transferred to recording paper 16. After passing through the transfer section, recording paper 16 is separated from photosensitive drum 11 and input to fixing unit 19 functioning as an image heating apparatus, where fixing of the transferred toner image is performed. Recording paper 16 on which the image has been heat-fixed is ejected into an ejection tray 20.

After separation of recording paper 16, the surface of photosensitive drum 11 is cleaned by having residual matter such as remaining transferred toner removed by a cleaning apparatus 21, and is ready for the next image forming operation.

In an image heating apparatus according to Embodiment 1, a center-based paper feed method is used whereby both narrow paper and wide paper are transported with their center line in the width direction coinciding with the center position in the rotating axis direction of fixing unit 19.

Fixing unit 19 in the above-described image forming apparatus will now be described in detail with reference to FIG. 5 and FIG. 6.

Figure 5:
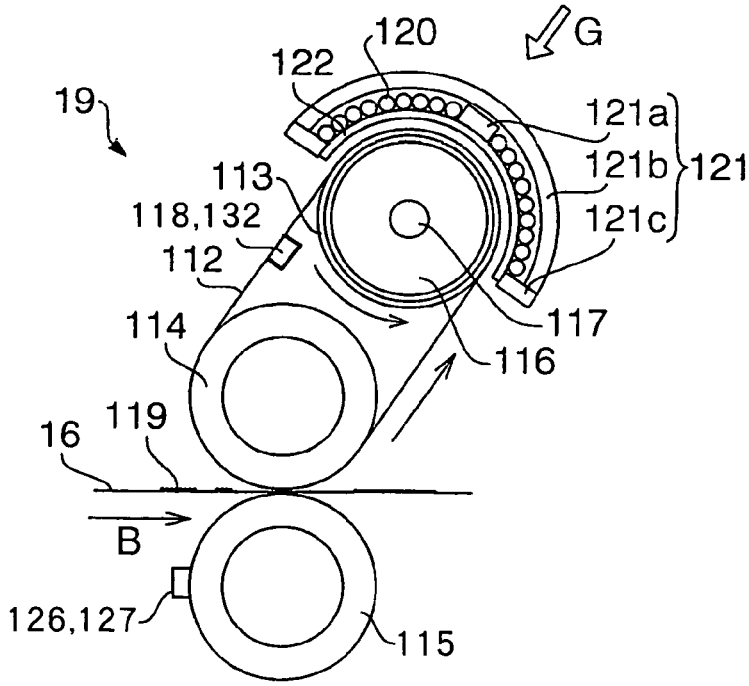
FIG. 5 is a cross-sectional drawing of an image heating apparatus according to Embodiment 1 of the present invention.
Figure 6:
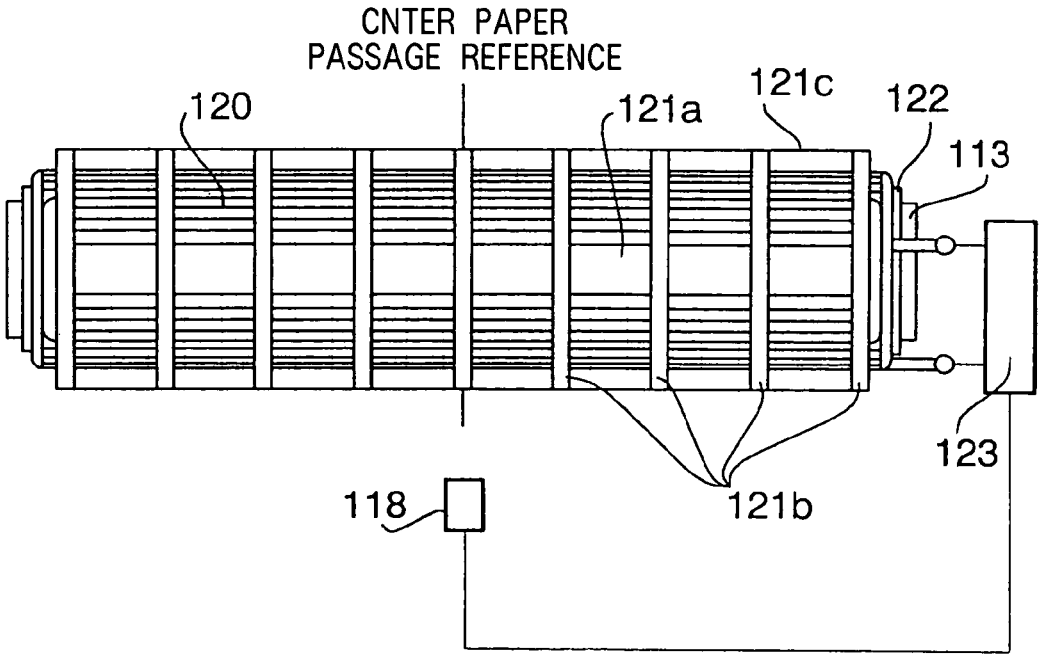
FIG. 6 is a rear view of an image heating apparatus viewed from the direction indicated by arrow G in FIG. 5.

As shown in FIG. 5 and FIG. 6, fixing unit 19 has a thin, endless fixing belt 112 as a heat-producing member. Fixing belt 112 is made of polyimide resin in which conductive powder is dispersed to provide electrical conductivity.

Fixing belt 112 has a JIS-A25 degree, 150 μm silicone rubber layer laid upon a 45 mm diameter, 100 μm thick base material surface, and a 20 μm thick fluororesin release layer further laid upon this silicone rubber layer.

However, the configuration of fixing belt 112 is not limited to this. For example, heat-resistant fluororesin, PPS (polyphenylene sulfide), or a similar material in which conductive powder is dispersed, or electroformed thin metal such as nickel or stainless steel, can be used as the base material of fixing belt 112.

Also, resin or rubber with good release characteristics such as PTFE (polytetrafluoroethylene) PFA (tetrafluoroethylene-perfluoroalkylvinyl ether copolymer), FEP (fluorinated ethylene propylene copolymer), or the like, may be used, alone or mixed, for the surface release layer of fixing belt 112.

A fixing belt 112 heat-producing layer can be used whose thickness is more than twice as thin as the skin depth corresponding to an induction heating high-frequency current. If the heat-producing layer is thicker than this, magnetic flux for induction heating will not penetrate the heat-producing member, and consequently the effect of the heat production adjustment section provided on the opposite side of the heat-producing member from the excitation section will decrease.

A retaining roller 113 is made of a resin such as PPS, which is an insulating material, and has a diameter of 20 mm and thickness of 0.3 mm. Retaining roller 113 is provided with bearings (not shown) that support the outer peripheral surface at either end, and is supported in a rotatable fashion. Ribs (not shown) to prevent snaking of fixing belt 112 are also provided at either end of retaining roller 113.

A fixing roller 114 is a 30 mm diameter low-thermal-conductivity fixing roller whose surface is of elastic foam silicone rubber of low hardness (Asker C45 degrees).

Fixing belt 112 is suspended between retaining roller 113 and fixing roller 114 under predetermined tension, and is moved in the direction indicated by the arrow.

A pressure roller 115 functioning as a pressure member of the pressure section has an external diameter of 30 mm and a surface of silicone rubber with a hardness of JIS A60 degrees. As shown in FIG. 5, pressure roller 115 presses against fixing belt 112, forming a nip between pressure roller 115 and fixing belt 112.

Pressure roller 115 is rotated by a drive section of the main body of the apparatus (not shown). Fixing belt 112 and fixing roller 114 are driven around by the rotation of pressure roller 115. To increase wear resistance and releasability, the surface of pressure roller 115 may be covered with PFA, PTFE, FEP, or similar rubber or resin, alone or mixed.

An exciting coil 120 functioning as an excitation section induction-heats fixing belt 112. The configuration of exciting coil 120 will be described in detail later herein.

An opposed core 116 functioning as a magnetic flux adjustment section is a magnetic body made of a high-permeability magnetic material that has insulating properties, such as ferrite. Opposed core 116 is installed in a continuously rotatable fashion inside retaining roller 113 facing exciting coil 120 via fixing belt 112.

Figure 8:
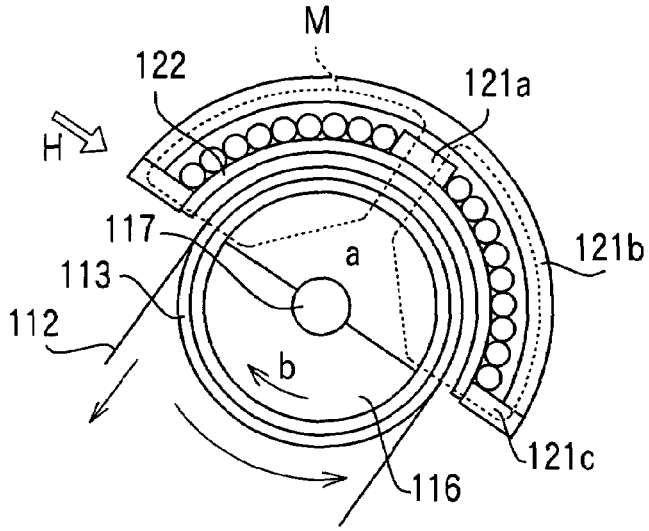
FIG. 8 is an explanatory drawing of the electromagnetic induction action of an image heating apparatus according to Embodiment 1 of the present invention showing a cross-sectional view perpendicular with respect to the rotation axis.
Figure 9:
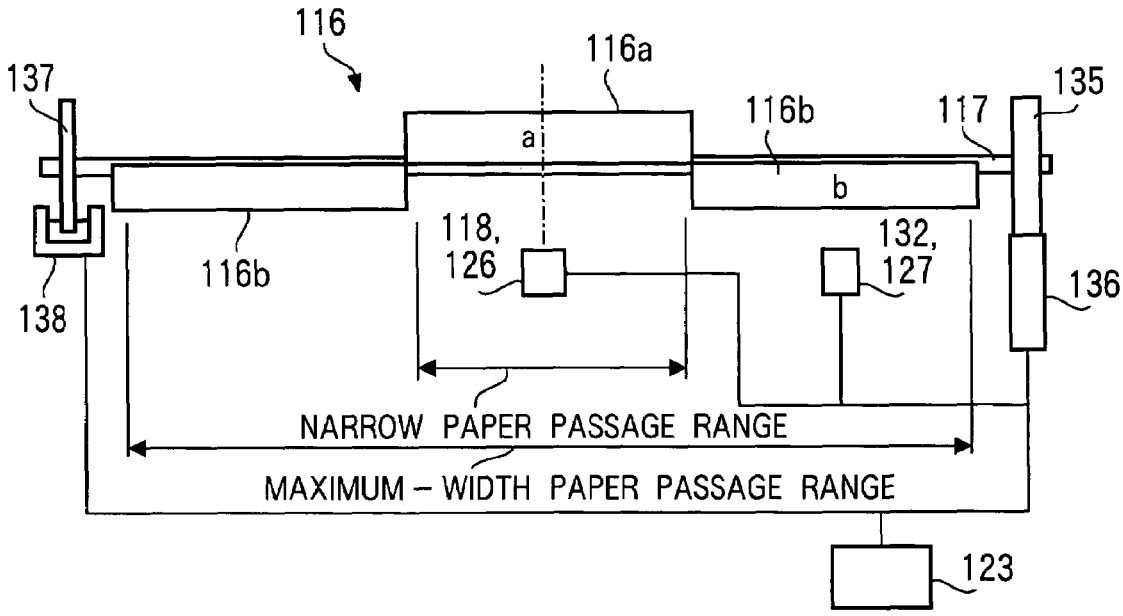
FIG. 9 is a configuration drawing of a magnetic flux adjustment section viewed from the direction indicated by arrow H in FIG. 8 showing a cross-sectional view parallel with respect to the rotation axis.

As shown in the cross sectional view in FIG. 8, that is perpendicular with respect to the rotation axis 117, and the cross sectional view in FIG. 9, that is parallel with respect to the rotation axis 117, opposed core 116 is configured so that the shape of the cross section parallel with respect to rotation axis 117 varies in the axial direction between the part corresponding to the narrow paper non-passage area and the central parts. In opposed core 116 according to Embodiment 1, semicylindrical core members 116*a* and 116*b* are fitted in combination in the axial direction of a rotating spindle 117 with their phases varying by 180 degrees relative to rotating spindle 117. The clearance between the circumferential surface of opposed core 116 and the inner peripheral surface of retaining roller 113 is 0.5 mm.

As shown in FIG. 8, opposed core 116 is divided into areas a and b split approximately equally into two in the plane containing rotating spindle 117. In FIG. 8, in area a, core member 116*a* faces only the narrow paper passage area in the center part in the axial direction, and core members 116*b* face only the parts corresponding to the narrow paper non-passage areas at either end.

In FIG. 9, a gear 135 is fitted to the right-hand end of opposed core 116. Through the transmission of the rotation of rotation section 136 to gear 135, opposed core 116 is rotated continuously at uniform velocity in the opposite direction to the direction of rotation of fixing belt 112.

At the other end of opposed core 116 are fitted a disk 137 that has a notch, and a photosensor 138 that detects the notch in disk 137 during rotation.

Rotation section 136 has a stepping motor. Rotation section 136 detects the home position of opposed core 116 by means of a photosensor 138 detection signal. Rotation section 136 detects the angle of rotation from the home position as a number of stepping motor drive pulses. With this configuration, an image heating apparatus according to Embodiment 1 does not require an expensive detection apparatus such as a high-resolution encoder as an opposed core 116 rotational phase detector, and the configuration is consequently simple and inexpensive.

An unfixed toner image 119 is formed on recording paper 16 as shown in FIG. 5. A temperature sensor 118 is located close to the width-direction center of fixing belt 112 comprising the narrow paper passage area, and measures the temperature of that area. A temperature sensor 132 is also located close to fixing belt 112 in a narrow paper non-passage area and wide paper passage area.

In addition, a temperature sensor 126 is located close to the width-direction center of pressure roller 115 comprising the narrow paper passage area, and measures the temperature of that area. Furthermore, a temperature sensor 127 is located close to pressure roller 115 in a narrow paper non-passage area and wide paper passage area, and measures the temperature of that area.

With fixing unit 19 functioning as an image heating apparatus according to Embodiment 1, the maximum width of recording paper that can pass through is assumed to be the short side (297 mm in length) of JIS standard A3 paper.

As shown in FIG. 6, exciting coil 120 functioning as the excitation section of the magnetic flux generation section is formed of 9 turns of a wire bundle comprising 100 copper wires with an external diameter of 0.15 mm and an insulated surface.

As shown in FIG. 5 and FIG. 6, the wire bundle of exciting coil 120 is arranged in an arc shape along the outer peripheral surface of retaining roller 113 at the ends of retaining roller 113, and is placed along the bus line direction of that outer peripheral surface in other parts. The wire bundle of exciting coil 120 placed along the bus line direction is located on a virtual cylindrical surface with the rotation axis of retaining roller 113 as its center axis. At the edges of fixing belt 112, exciting coil 120 wire bundles are raised by being stacked in two rows.

An excitation core 121 is composed of ferrite as high-permeability material (with relative permeability of 2000, for example).

Excitation core 121 is composed of a center core 121*a*, arch cores 121*b*, and a pair of side cores 121*c*. Center core 121*a* is located at the circulation center of exciting coil 120 and parallel to the rotation axis of fixing belt 112. Arch cores 121*b* are approximately arch-shaped, and are located on the opposite side of exciting coil 120 from fixing belt 112. The pair of side cores 121*c* are located parallel to the rotation axis of fixing belt 112.

As shown in FIG. 6, a plurality of arch cores 121*b* are spaced in the rotation axis direction of fixing belt 112. Center core 121*a* is located inside the aperture of the center part of circulated exciting coil 120. Also, the pair of side cores 121*c* are connected to either end of arch cores 121*b*, and face fixing belt 112 without the intermediation of exciting coil 120. Center core 121*a*, arch cores 121*b*, and side cores 121*c* are magnetically coupled.

Apart from ferrite, a material of high magnetic permeability and low resistivity, such as ferrosilicon sheet, for example, is desirable as the material of excitation core 121. Also, center core 121*a* and side cores 121*c* may be divided in to a plurality in the lengthwise direction.

A coil supporting member 122 is of 2 mm thick PEEK (polyetheretherketone), PPS (polyphenylene sulfide), or a similar resin with a high heat-resistant temperature. Exciting coil 120 and excitation core 121 maintain the shape shown in the drawing by being attached to coil supporting member 122.

Figure 7:
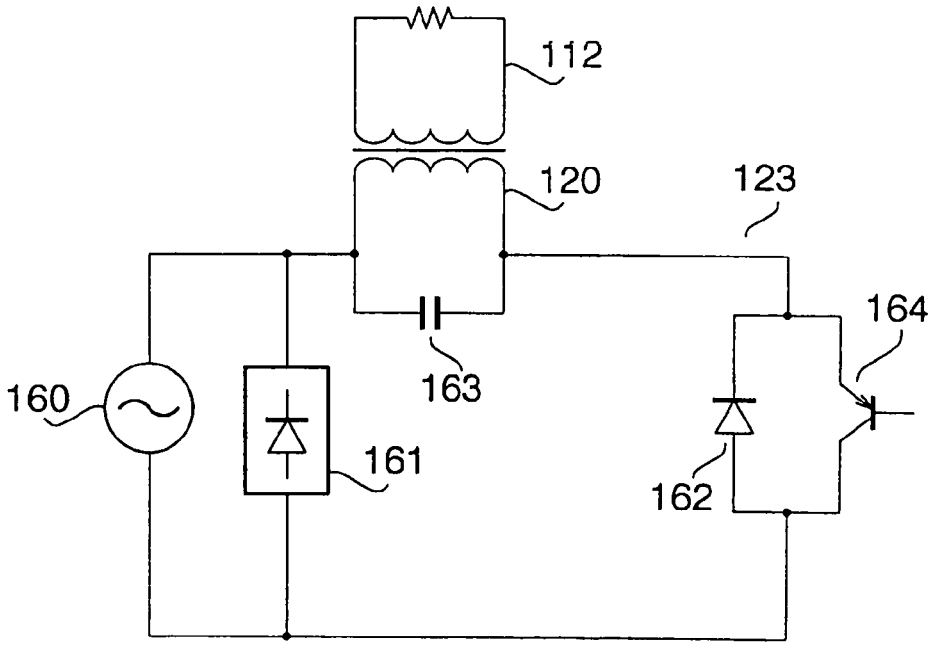
FIG. 7 is a circuit diagram showing the basic configuration of the exciting circuit of an image heating apparatus according to Embodiment 1 of the present invention.

FIG. 7 shows the basic circuit diagram of a monolithic resonance type inverter used for an excitation circuit 123. In FIG. 7, an alternating current from a commercial power supply 160 is rectified by a rectifier circuit 161, and applied to the inverter.

In this inverter, a high-frequency current is applied to exciting coil 120 by switching of a switching element 164 such as an IGBT (Insulated Gate Bipolar Transistor) and a resonance capacitor 163. A diode 162 is connected in parallel to switching element 164.

In an image heating apparatus according to Embodiment 1, an alternating current with a maximum voltage amplitude of 650 V and a maximum current amplitude of 65 A and is applied from excitation circuit 123.

A 30 kHz alternating current with a maximum current amplitude of 60 A and a maximum voltage amplitude of 600 V is applied to exciting coil 120 from excitation circuit 123, a voltage resonance type inverter.

Temperature sensor 118 is positioned in the center of the rotation axis direction of fixing belt 112, pressing against fixing belt 112. The alternating current applied to exciting coil 120 is controlled by a temperature signal from temperature sensor 118 so that the surface temperature of fixing belt 112 becomes 170 degrees centigrade, which is the fixing set temperature.

The excitation circuit 123 drive timing is controlled taking into consideration the temperature signal from temperature sensor 132 provided for fixing belt 112, the detection signal from photosensor 138 that detects the rotational phase of opposed core 116, and the temperature signals from temperature sensors 126 and 127 provided for pressure roller 115.

In an image forming apparatus that has a fixing unit 19 configured as described above, a toner image is formed on the outer surface of photosensitive drum 1 (see FIG. 1). This toner image 17 is transferred to the surface of recording paper 16. Recording paper 16 is transported into the nip area from the direction of the arrow in FIG. 1. By this means toner image 17 is heat-fixed, and a recorded image is obtained on recording paper 16.

In the image heating apparatus of this embodiment, above-described exciting coil 120 causes fixing belt 112 to produce heat by means of electromagnetic induction. The heat-producing state of fixing belt 112 is described below with reference to FIG. 8.

In FIG. 8, magnetic flux M generated by exciting coil 120 due to an alternating current from excitation circuit 123 penetrates fixing belt 112 from side cores 121*c* of excitation core 121 as shown by the dotted lines. Magnetic flux M that has penetrated fixing belt 112 enters opposed core 116 inside retaining roller 113, and passes through the interior of opposed core 116 due to the magnetic properties of opposed core 116.

Magnetic flux M that has passed through the interior of opposed core 116 then penetrates fixing belt 112 again and enters center core 121*a* of excitation core 121, passes through arch cores 121*b*, and reaches side cores 121*c*.

This magnetic flux M goes through repeated creation and annihilation due to the alternating current of excitation circuit 123. An induction current generated by variations of this magnetic flux M flows inside fixing belt 112 and generates Joule heat.

Center core 121*a* and side cores 121*c* consecutive in the fixing belt 112 rotation axis direction have an effect of scattering magnetic flux M that has passed through arch cores 121*b* in the rotation axis direction and uniformizing the magnetic flux density.

Next, the operation of opposed core 116 will be described. When the surfaces of core members 116*a* and 116*b* of opposed core 116 come close to and face exciting coil 120, the magnetic pemeability of the area through which magnetic flux M passes increases. As a result, the magnetoresistance of this area falls, and magnetic coupling between exciting coil 120 and fixing belt 112 improves.

Therefore, in this state, the heat production temperature of fixing belt 112 in this area can be raised.

On the other hand, when the surfaces of core members 116*a* and 116*b* of opposed core 116 are distanced from excitation coil 120, magnetic flux M passes through air, which has low magnetic permeability. Therefore, in this state, the heat production temperature of fixing belt 112 in this area falls.

That is to say, with this image heating apparatus, when exciting coil 120 heats at a rotational phase at which area a of opposed core 116 is opposite exciting coil 120, the central narrow paper passage area part is strongly heated. Then, with this image heating apparatus, when exciting coil 120 heats at a rotational phase at which area b is opposite exciting coil 120, the end narrow paper non-passage areas are strongly heated.

Thus, in an image heating apparatus according to this embodiment, the calorific value distribution of fixing belt 112 can be adjusted by having opposed core 116 rotate continuously and adjusting the timing of heating by exciting coil 120 in accordance with the rotational phase of opposed core 116.

Figure 10A:
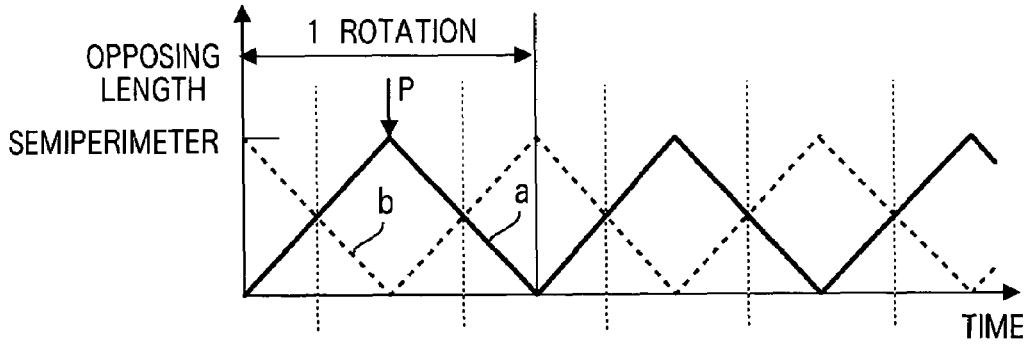
FIG. 10A is an explanatory drawing showing the rotational phases of an opposed core in an image heating apparatus according to Embodiment 1 of the present invention.

Next, the rotational phases of opposed core 116 and the excitation operation patterns of exciting coil 120 will be described with reference to FIG. 10A and FIG. 10B. In FIG. 10A, the horizontal axis indicates the passage of time, and the vertical axis indicates with a solid line and doffed line respectively the lengths core members 116*a* and 116*b* (hereinafter simply referred to as areas "a" and "b") in the areas of opposed core 116 come close to and face excitation coil 120 (the length in the cross-sectional view perpendicular with respect to the rotation axis). The lengths faced by areas a and b of opposed core 116 in exciting coil 120 vary with the passage of time since opposed core 116 rotates continuously. Point P indicates the state shown in FIG. 8 where area a is directly opposite exciting coil 120.

Figure 10B:
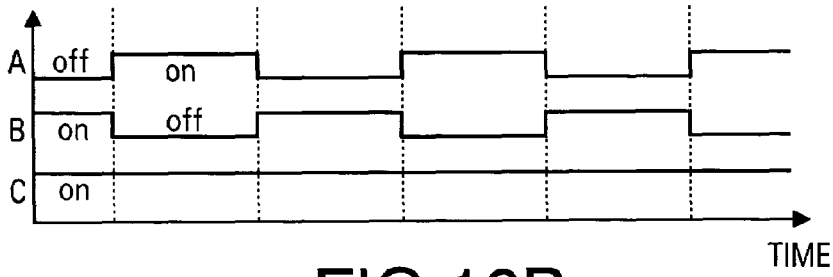
FIG. 10B is an explanatory drawing showing the excitation operation patterns of an exciting coil in an image heating apparatus according to Embodiment 1 of the present invention corresponding to the opposed core rotational phases shown in FIG. 10A.

In FIG. 10B, the horizontal axis indicates the passage of time, and the vertical axis indicates the excitation operation patterns of exciting coil 120. In excitation operation pattern A, area a heats when opposite exciting coil 120, and the center part of fixing belt 112 is heated strongly. In excitation operation pattern B, area b heats when opposite exciting coil 120, and the end parts of fixing belt 112 are heated strongly. In excitation operation pattern C, the entire width of fixing belt 112 is heated continuously.

In an image heating apparatus according to Embodiment 1, while fixing belt 112 passes through an approximately 180-degree area heated by exciting coil 120, opposed core 116 rotating at uniform velocity in the opposite direction performs one rotation phase-wise. Therefore, with this image heating apparatus, for example, the center part of fixing belt 112 is heated strongly in the first half of the heating area, and the edges are heated strongly in the second half. As a result, with this image heating apparatus, the entire width of fixing belt 112 is heated uniformly.

Incidentally, when opposed core 116 and fixing belt 112 move in the same direction at uniform velocity (to be exact, uniform angular velocity), the opposing positions of opposed core 116 and fixing belt 112 are relatively invariant while passing through the heating section. Consequently, in this case, the calorific value distribution conforming to the state of opposed core 116 becomes the calorific value distribution directly.

That is to say, for a part of fixing belt 112 faced by area a of opposed core 116, the center temperature becomes higher and the edge temperature becomes lower. Also, for a part of fixing belt 112 faced by area b of opposed core 116, the center temperature becomes lower and the edge temperature becomes higher. To prevent the occurrence of this temperature difference, it is necessary, at least, to provide a speed difference between opposed core 116 and fixing belt 112 in the heating section.

Thus, in an image heating apparatus according to Embodiment 1, opposed core 116 and fixing belt 112 are rotated at uniform velocity in opposite directions.

Switching of the above-described excitation operation patterns is performed as described below.

The temperature difference between center temperature sensor 118 and end temperature sensor 132 shown in FIG. 9 is assumed to be less than a predetermined temperature difference (for example, 15° C.). Also, the temperature measured by temperature sensor 132 is assumed to be lower than a first predetermined temperature (for example, 180° C.) that is higher than the fixing temperature (for example, 170° C.).

In this case, exciting coil 120 is operated using excitation operation pattern C shown in FIG. 10B, and fixing belt 112 is heated continuously. By this means, fixing belt 112 passing through the heating area is heated uniformly in the width direction.

If recording paper 16 fed through is wide, heat is absorbed across virtually the entire width of fixing belt 112, and the temperature of fixing belt 112 is maintained uniformly across that entire width.

If narrow recording paper 16 is passed through in such a state, heat of only the center part of fixing belt 112 is absorbed by recording paper 16. In this case, temperature control is performed based on temperature sensor 118 at the center of fixing belt 112, and therefore the temperature of both edge parts, which are paper non-passage areas, rises.

Thus, in this image heating apparatus, if the temperature measured by temperature sensor 132 exceeds 180° C., exciting coil 120 is driven intermittently using excitation operation pattern A shown in FIG. 10B. As a result, heat production distribution of the narrow paper non-passage areas of fixing belt 112 declines, and an excessive rise in the temperature of the paper non-passage areas can be prevented.

Then, when the temperature measured by temperature sensor 132 becomes a second predetermined temperature (for example, 160° C.) that is lower than the fixing temperature, exciting coil 120 is subjected to continuous heating drive using excitation operation pattern C, and calorific value distribution With this excitation On the other hand, if a printing operation is performed with narrow paper when fixing unit 19 is cold (for example, at room temperature), heating of fixing belt 112 is started with excitation operation pattern A in FIG. 10B in order to heat only the center part of fixing belt 112.

In this case, since only the center part of fixing belt 112 is heated, the thermal capacity required for heating need only be small. Therefore, with this image heating apparatus, the temperature can be raised to the predetermined temperature (170° C.) with little energy, and if heating is performed with the same power, the temperature can be raised in a short time.

In this case, the temperature of fixing belt 112 in the paper non-passage areas does not rise to the fixing temperature, and it is therefore possible to prevent the temperature of pressure roller 115 in the paper non-passage areas from becoming excessively higher than in the paper passage area.

In this case a state is established in which the temperature of center temperature sensor 118 is higher than that of end temperature sensor 132. If wide paper is next to be fed through in this state, it is necessary to heat only both end parts of fixing belt 112.

Thus, in this case, exciting coil 120 is driven using excitation operation pattern B in FIG. 10B. In the calorific value distribution with this excitation operation pattern, the calorific value of the center part of fixing belt 112 is small, and the calorific value of the end parts is large. By this means it is possible to move from a state in which the temperature of the end parts of fixing belt 112 is low to a state of uniform calorific value distribution.

Here, since the end parts of fixing belt 112 are not heated strongly during continuous passage of narrow paper, the temperature is low, and the temperature of the paper non-passage areas of pressure roller 115 does not rise excessively. Therefore, with this image heating apparatus, even when wide paper is fed through, it is possible to prevent irregularities such as uneven glossiness of a fixed image caused by nonuniformity of the temperature of pressure roller 115, enabling high-quality images to be obtained.

Excitation operation pattern B in FIG. 10B can be employed when the temperature of center temperature sensor 118 shows at least a predetermined temperature difference (for example, 15° C.) from that of end temperature sensor 132.

As described above, according to an image heating apparatus of Embodiment 1, the calorific value distribution of fixing belt 112 can be kept constantly virtually uniform even when narrow paper is continuously fed through. Therefore, fixing defects such as cold offset or hot offset due to nonuniformity of fixing calorific value distribution can be prevented when wide paper is fed through immediately after narrow paper is fed through, or when narrow paper and wide paper are fed through alternately.

Also, with this image heating apparatus, when starting up for narrow paper printing, it is possible to heat only the center part of fixing belt 112. Therefore, with this image heating apparatus, the temperature of fixing belt 112 can be raised with little energy, and also, the temperature can be raised in a short time if heating is performed with the same power. Furthermore, with this image heating apparatus, uniform calorific value distribution can be restored when the temperature of the end parts has become too low relative to that of the center part of fixing belt 112 through heat dissipation to the end parts of fixing belt 112 or the like.

Moreover, with this image heating apparatus, adjustment of the calorific value distribution of fixing belt 112 is performed by changing the excitation operation pattern of exciting coil 120. Therefore, with this image heating apparatus, a mechanical exciting coil 120 excitation operation pattern switching section is unnecessary, making it possible to prevent the generation of abnormal noises such as operating sounds associated with the aforementioned excitation operation switching. Furthermore, with this image heating apparatus, time for exciting coil 120 excitation operation switching is not required, making it unnecessary to provide standby time, and enabling changes to be performed frequently.

Also, with this image heating apparatus, opposed core 116 is continuously rotated as an integral unit, and therefore the mechanism for rotational drive is simple. Moreover, with this image heating apparatus, opposed core 116 is rotated inside retaining roller 113, enabling the heat-producing section to be made small.

Furthermore, since opposed core 116 rotates continuously with a uniform cross-sectional area in the axial direction, the calorific value distribution of the heat-producing section is uniform in the axial direction. Therefore, with this image heating apparatus, a uniform calorific value distribution can easily be achieved by performing heating across the entire width of fixing belt 112 with a single exciting coil 120.

Also, with this image heating apparatus, by locating high-permeability opposed core 116 within the induction heating magnetic path, leakage of magnetic flux outside fixing unit 19 can be prevented.

Moreover, by heating fixing belt 112 using a part wrapped around retaining roller 113 as a heat-producing section, the shape of fixing belt 112 is stabilized and a constant distance can easily be maintained between fixing belt 112 and exciting coil 120.

With a conventional fixing unit, if the temperature of both ends of fixing belt 112 becomes excessively high when narrow paper is fed through continuously, it is necessary to stop the printing operation and wait until the temperature of both ends falls, or to increase the recording paper 16 feeding interval.

However, with an image heating apparatus according to Embodiment 1, a rise in the temperature of both ends of fixing belt 112 when narrow paper is fed through continuously can be suppressed, making it unnecessary to wait or increase the paper feeding interval in the event of an excessive rise in temperature. Therefore, with this image heating apparatus, throughput—the number of sheets output per unit time—can be set high when outputting narrow paper continuously.

Furthermore, with this image heating apparatus, a rise in temperature of paper non-passage areas of pressure roller 115 can be prevented, making it possible to prevent a drop in image quality because of uneven fixing due to the calorific value distribution of pressure roller 115.

Also, with this image heating apparatus, the proportions of strong heat-producing and weak heat-producing areas in the circumferential direction are uniform in the axial direction, enabling uniform full-width heating to be achieved when the entire width of fixing belt 112 is heated.

In an image heating apparatus according to Embodiment 1, the exciting coil 120 excitation timing is reversed by 180 degrees with respect to the rotational phase of opposed core 116 in order to adjust the calorific value distribution. However, this opposed core 116 rotational phase angle is not limited to 180 degrees, and may be adjusted according to temperature variations of paper non-passage areas.

According to an image heating apparatus with this kind of configuration, the intensities of the calorific value distribution of paper non-passage areas can be controlled with a high degree of precision, and the calorific value distribution of fixing belt 112 can be made uniform.

Figure 11:
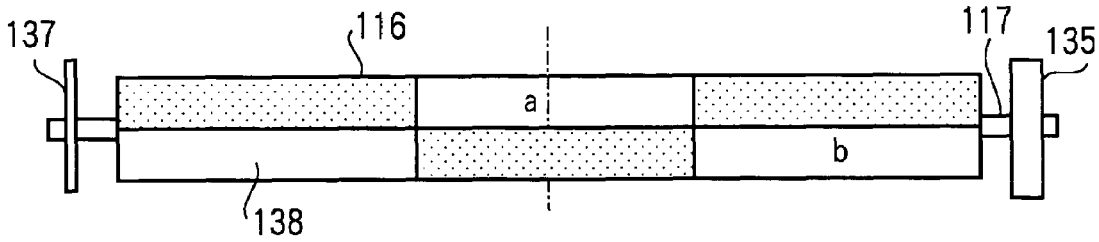
FIG. 11 is a configuration drawing showing another sample configuration of a magnetic flux adjustment section according to Embodiment 1 of the present invention.
Figure 12:
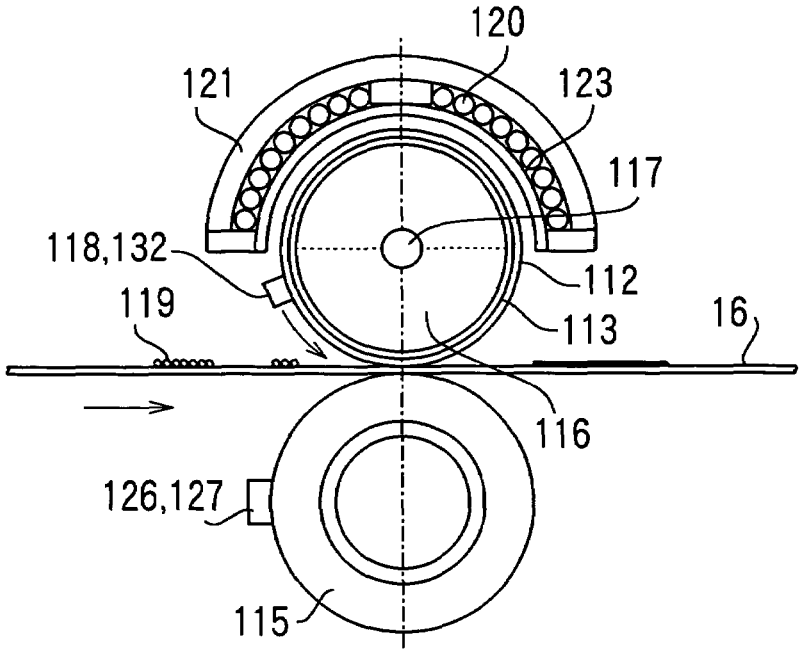
FIG. 12 is a cross-sectional drawing showing another sample configuration of an image heating apparatus according to Embodiment 1 of the present invention.

In the above-described image heating apparatus, a member is not specially provided in the part on the opposite side of the semicircular cross-sectional shape of opposed core 116, but an adjustment member 138 of different permeability from that of opposed core 116 may be provided in the part on the opposite side, as shown in FIG. 11.

If a magnetic material of lower permeability than opposed core 116 (such as ferrite resin with a permeability of 10, for example) is used for this adjustment member 138, the difference in peak intensity of the calorific value can be adjusted arbitrarily in accordance with the permeabilities of opposed core 116 and adjustment member 138.

Also, if a nonmagnetic conductive material such as aluminum or copper is used for adjustment member 138, the difference in peak intensity of the calorific value can be further increased. This is because conductive material has a property of being susceptible to the flow of an eddy current in an induced magnetic field and scarcely allowing the passage of induced magnetic flux inside.

Furthermore, as opposed core 116 has a uniform cross-sectional shape in the axial direction, thermal capacity distribution of the heat-producing section approaches uniformity in the axial direction. Therefore, in an image heating apparatus using the opposed core 116 shown in FIG. 11, uniform calorific value distribution can easily be achieved by heating fixing belt 112 uniformly by means of exciting coil 120.

The cross-sectional shape of opposed core 116 may also be varied stepwise from the center part toward the ends, taking the recording paper 16 widths used into consideration. According to this kind of configuration, recording paper 16 of a plurality of widths can be provided for, and the difference in calorific values at the boundary of a heated part and unheated part (strong and weak calorific value distribution areas) can be made pronounced.

In an image heating apparatus according to Embodiment 1, the distance between opposed core 116 and retaining roller 113 is taken to be 0.5 mm, but it is desirable for this distance to be in the range 0.3 mm to 2 mm. If the distance is less than this, nonuniformity of heat transfer distribution may occur in the axial direction due to partial contact of retaining roller 113 and opposed core 116. As a result, nonuniformity of calorific value distribution may occur despite uniform heating, preventing a uniform fixed image from being obtained. On the other hand, if this distance is too large, magnetic coupling between exciting coil 120 and fixing belt 112 will be poor, and it may not be possible to perform induction heating efficiently.

In an image heating apparatus according to Embodiment 1, the configuration of fixing unit 19 has fixing belt 112 suspended between retaining roller 113 and fixing roller 114, and an exciting coil opposite retaining roller 113, but the configuration of fixing unit 19 is not limited to this.

For example, as the above-described configuration, it is possible to implement a configuration of fixing unit 19 in which a fixing belt 112 of the same diameter encloses the perimeter of retaining roller 113, and retaining roller 113 is pressed against pressure roller 115 via fixing belt 112.

With this configuration, it is not necessary to provide fixing roller 114 and retaining roller 113 separately, and a mechanism providing tension to fixing belt 112 is also unnecessary, enabling the configuration to be made simple and inexpensive.

Also, with this configuration the peripheral length of fixing belt 112 is shortened, reducing the thermal capacity in the case of a rise in temperature, and thus decreasing the energy necessary for a temperature rise and at the same time enabling the temperature rise time to be shortened.

With an image heating apparatus according to Embodiment 1, opposed core 116 is rotated at uniform velocity in the opposite direction to fixing belt 112, but the relative speeds of the two are not limited to this case.

When rotated in opposite directions, the downstream end of a part of opposed core 116 opposite exciting coil 120 need only rotate at a speed greater than or equal to movement up to the upstream end on the opposite side while an arbitrary part of fixing belt 112 passes through an area opposite exciting coil 120.

By this means, opposed core 116 rotates one or more times relative to fixing belt 112 in the time in which fixing belt 112 is heated. Therefore, with this configuration, differences in calorific value distribution intensity due to variations of the cross-sectional shape and electromagnetic characteristics of opposed core 116 are evened out throughout, enabling the calorific value distribution to be made uniform across the entire width of fixing belt 112.

It is desirable for the above-described relative speed difference to be an integral number of rotations. By this means, differences in circumferential-direction calorific value distribution intensity are fully evened out, enabling the axial-direction calorific value distribution to be made uniform.

In this case, the lower the rotational speed of opposed core 116, the more drive noise and drive power can be decreased. Also, with this image heating apparatus, by rotating opposed core 116 in the opposite direction to fixing belt 112, relative speed can be increased even if rotational speed is low.

Therefore, with this image heating apparatus, performing rotation in opposite directions enables the rotational speed of opposed core 116 to be set low. Also, when the exciting coil 120 heating area is a 180-degree range with respect to the rotation axis of opposed core 116, although opposed core 116 is rotated at uniform velocity in the opposite direction, the speed of opposed core 116 can actually be set low.

Furthermore, with this image heating apparatus, a configuration is also possible in which opposed core 116 is moved in the same direction as fixing belt 112. In this case, the magnetic flux adjustment section need only rotate an integral number of times while an arbitrary part of the heating member passes through an area opposite the excitation section. By this means, opposed core 116 rotates one or more times relative to fixing belt 112 in the time in which fixing belt 112 is heated. Therefore, differences in calorific value distribution intensity due to variations of the cross-sectional shape and electromagnetic characteristics of opposed core 116 are evened out throughout, enabling the calorific value distribution to be made uniform across the entire width of fixing belt 112.

EMBODIMENT 2

Figure 13:
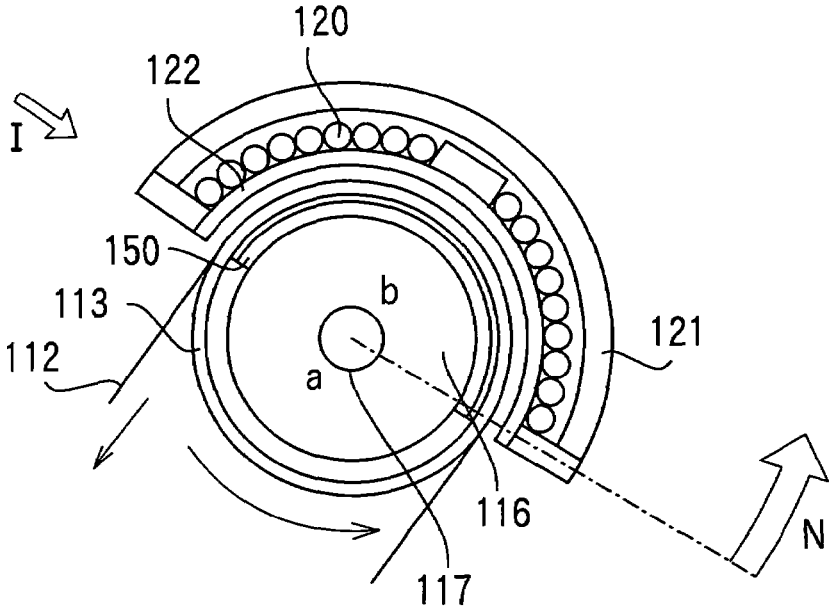
FIG. 13 is a cross-sectional drawing of an image heating apparatus according to Embodiment 2 of the present invention.
Figure 14:
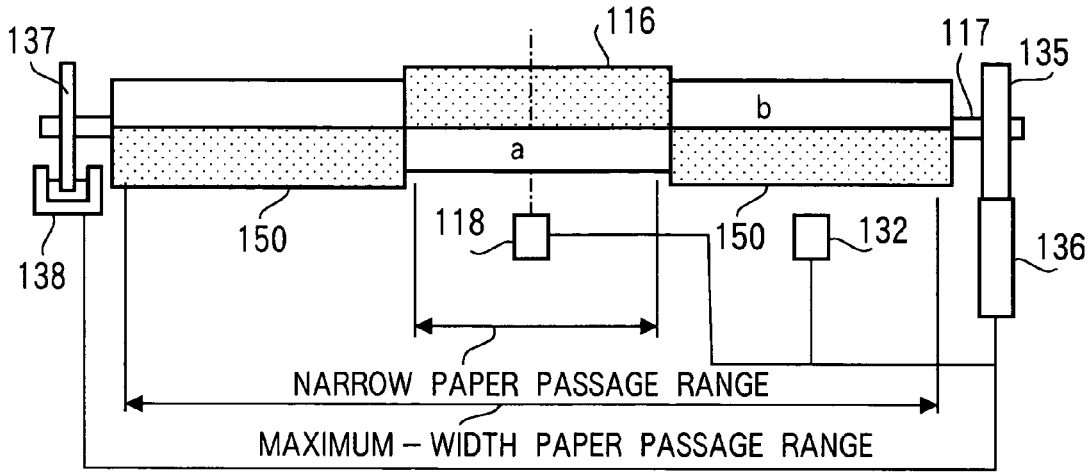
FIG. 14 is a configuration drawing of a magnetic flux adjustment section viewed from the direction indicated by arrow I in FIG. 13.

FIG. 13 is a cross-sectional drawing of the center part of the heat-producing section of a fixing unit 19 according to Embodiment 2 of the present invention, and FIG. 14 is a configuration drawing of opposed core 116 constituting a magnetic flux adjustment section viewed from the direction indicated by arrow I in FIG. 13.

This embodiment differs from Embodiment 1 in the configuration of the magnetic flux adjustment section. That is to say, in an image heating apparatus according to Embodiment 2 a suppression member 150 of a nonmagnetic conductive material such as aluminum is provided on half of the circumferential direction of surfaces corresponding to narrow paper non-passage areas of opposed core 116 comprising a cylindrical body and surfaces corresponding to narrow paper non-passage areas at a position displaced by 180 degrees with respect to rotating spindle 117 of opposed core 116. The distance between opposed core 116 and the inner peripheral surface of retaining roller 113 is 0.6 mm, and the thickness of suppression member 150 is 0.3 mm.

Also, with an image heating apparatus according to Embodiment 2, the excitation operation timing of exciting coil 120 with respect to the rotational phase of opposed core 116 functioning as a heat production adjustment section is controlled in accordance with the temperature of pressure roller 115.

Other details are similar to those of an image heating apparatus according to Embodiment 1, and configuration members in this embodiment that have the same action as in Embodiment 1 are assigned the same codes as in Embodiment 1, and detailed descriptions thereof are omitted.

As shown in FIG. 13, the peripheral surface of suppression member 150 forms a semicylindrical surface that is uniform in the axial direction. In FIG. 14, the center part of opposed core 116 corresponding to the axial direction in which suppression member 150 is absent in the center is designated area a. Areas in which suppression member 150 is absent at either end of opposed core 116 are semi cylinder shapes whose phases with respect to the rotation axis coincide at both ends, and an area corresponding to this axial direction is designated area b.

Next, a description will be given of the operation and action of opposed core 116 as a heat production adjustment section in an image heating apparatus according to Embodiment 2.

In FIG. 13, when an area of opposed core 116 in which suppression member 150 is absent is opposite fixing belt 112, the permeability of the area through which magnetic flux passes increases. As the magnetoresistance of this area falls, magnetic coupling between exciting coil 120 and fixing belt 112 improves. Therefore, the calorific value distribution of this part of the fixing belt can be increased.

On the other hand, when suppression member 150 intermediates with respect to the surface of opposed core 116, an eddy current is induced in suppression member 150, and variation of the magnetic flux passing through suppression member 150 is prevented. Through this action, magnetic flux acting upon fixing belt 112 in a paper non-passage area from exciting coil 120 greatly diminishes. Consequently, the magnetic coupling between fixing belt 112 in a paper non-passage area and exciting coil 120 is poorer than in a paper passage area. As a result, with this image heating apparatus, the calorific value distribution of this part can be greatly decreased by performing induction heating when suppression member 150 is positioned opposite exciting coil 120.

Therefore, with this image heating apparatus, when exciting coil 120 heats at a rotational phase at which area a of opposed core 116 is opposite exciting coil 120, the central narrow paper passage area part is strongly heated. Then, when exciting coil 120 is excited at a rotational phase at which area b is opposite exciting coil 120, the end narrow paper non-passage areas are strongly heated.

In an image heating apparatus according to Embodiment 2, the calorific value distribution of fixing belt 112 is adjusted by having opposed core 116 rotate continuously and adjusting the operation timing of exciting coil 120 in accordance with the rotational phase of opposed core 116.

Opposed core 116 rotational phases and exciting coil 120 operation timing and excitation operation pattern switching are the same as in the case of an image heating apparatus according to Embodiment 1.

Next, control of the heat production adjustment section in accordance with the temperature of pressure roller 115 will be described.

With an image heating apparatus according to Embodiment 2, when heating is performed using excitation operation pattern A in FIG. 10B that heats the center part of fixing belt 112 strongly, and narrow paper is fed through continuously, the temperature of the end parts of pressure roller 115 becomes lower than that of the center part.

By strongly heating the end parts using excitation operation pattern B in FIG. 10B in order to feed through wide paper in this state, the temperature of fixing belt 112 can be made uniform, but there is a problem of the temperature of pressure roller 115 not becoming uniform. Consequently, a fixed image on wide paper is nonuniform, with fixing irregularities such as uneven glossiness occurring, and image quality falls.

If excitation operation pattern A and excitation operation pattern C that heat the entire width of fixing belt 112 are controlled alternately, and narrow paper is fed through continuously, the temperature of fixing belt 112 can be maintained constantly and uniformly at the 170° C. fixing temperature. However, the temperature of the paper passage area of pressure roller 115 only rises to 80° C. because heat is absorbed by recording paper 16.

On the other hand, paper non-passage areas of pressure roller 115 are continuously in contact with 170° C. fixing belt 112, and therefore rise to a temperature of 160° C., close to the fixing temperature. If wide paper is fed through in this state, even though the calorific value distribution of fixing belt 112 is uniform, fixing irregularities such as uneven glossiness occur because there is an 80° C. temperature difference in pressure roller 115, and image quality falls.

Thus, with an image heating apparatus according to Embodiment 2, the pressure temperature of the narrow paper passage area and the temperature of the paper non-passage areas of pressure roller 115 are measured by temperature sensors 126 and 127, and the excitation operation timing of exciting coil 120 is varied so that the calorific value distribution of pressure roller 115 becomes within a predetermined range.

That is to say, for example, if narrow paper is fed through after feeding through wide paper using excitation operation pattern C that heats the entire width of fixing belt 112, excitation operation pattern A is switched to when the temperature difference between pressure roller 115 paper non-passage area temperature sensor 127 and paper passage area temperature sensor 126 reaches a predetermined temperature difference (for example, 10° C.)

Then, when the temperature of the end parts of pressure roller 115 becomes lower than that of the center part by more than a predetermined temperature difference (for example, 15° C.) during continuous feeding of narrow paper using excitation operation pattern A, a change is made to excitation operation pattern C that heats the entire width of fixing belt 112.

By this means, the calorific value distribution of the narrow paper passage and non-passage areas of pressure roller 115 can be kept within a predetermined temperature range. Therefore, with this image heating apparatus, uniformly fixed high-quality images can be obtained with no standby time when wide paper is fed through after narrow paper is fed through continuously, or when narrow paper and wide paper are fed through alternately.

As described above, according to an image heating apparatus of Embodiment 2, when opposed core 116 is not in proximity to the fixing member, suppression member 150 comes into proximity to fixing belt 112. By this means, the difference between the peak of a strong calorific value distribution when opposed core 116 is in proximity and the peak of a weak calorific value distribution when suppression member 150 is opposite can be made large. As a result, with this image heating apparatus, differences in intensity of the calorific value distribution are large, and responsiveness for controlling the calorific value distribution improves.

Also, with this image heating apparatus, opposed core 116 is cylindrical, making it easy to ensure precision of shape even when opposed core 116 is made of a sintered material such as ferrite, and enabling opposed core 116 to be manufactured at low cost.

Furthermore, with this image heating apparatus, since opposed core 116 rotates continuously with a uniform cross-sectional area in the axial direction, the calorific value distribution of the heat-producing section is uniform in the axial direction. Therefore, with this image heating apparatus, a uniform calorific value distribution can easily be achieved by performing heating across the entire width of fixing belt 112 with a single exciting coil 120.

Also, with this image heating apparatus, the proportions of strong heat-producing and weak heat-producing areas in the circumferential direction are uniform in the axial direction, enabling uniform full-width heating to be achieved when the entire width of fixing belt 112 is heated.

Moreover, with this image heating apparatus, the calorific value distribution of pressure roller 115 can be kept within a predetermined temperature range by varying the excitation operation pattern of exciting coil 120 based on temperatures measured by pressure roller 115 temperature sensors 126 and 127. By this means, uniformly fixed high-quality images can be obtained with no standby time when wide paper is fed through after narrow paper is fed through continuously, or when narrow paper and wide paper are fed through alternately.

It is desirable for the conductive material of suppression member 150 to have a volume resistivity of not more than $10\times10^{-8}$ Ω·m to prevent heat generation due to induction heating. It is also desirable for the thickness of suppression member 150 to be not less than 0.2 mm in order to prevent induction heating. As the distance between opposed core 116 and fixing belt 112 at the center is increased by the thickness of suppression member 150, the thinner suppression member 150 is the better. In order to secure sufficient magnetic coupling between exciting coil 120, fixing belt 112, and opposed core 116, it is desirable for the thickness of suppression member 150 to be not more than 2 mm.

With an image heating apparatus according to Embodiment 2, the cross-sectional shape of opposed core 116 is uniformly cylindrical in the axial direction, but a recess corresponding to suppression member 150 may be provided, and the outer peripheral surface of other parts of opposed core 116 may be made the same circumferential surface as the outer peripheral surface of suppression member 150. In this case, the distance between opposed core 116 and fixing belt 112 is reduced by the thickness of suppression member 150, enabling magnetic coupling between exciting coil 120, fixing belt 112, and opposed core 116 to be increased.

EMBODIMENT 3

Figure 15A:
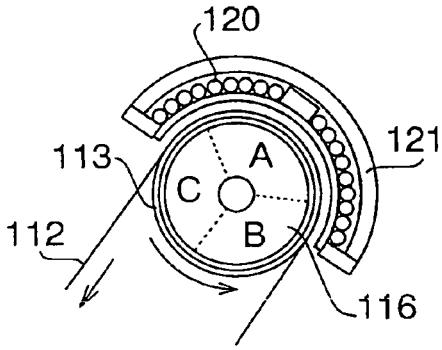
FIG. 15A is a cross-sectional drawing of an image heating apparatus according to Embodiment 3 of the present invention.
Figure 15B:
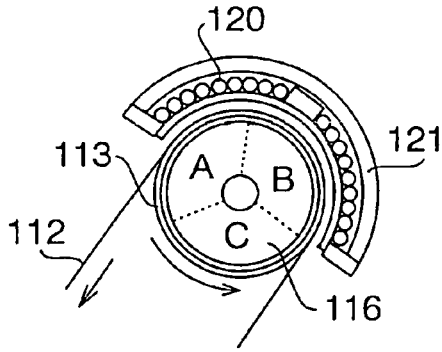
FIG. 15B is a cross-sectional drawing showing an operating mode of an image heating apparatus according to Embodiment 3 of the present invention.
Figure 15C:
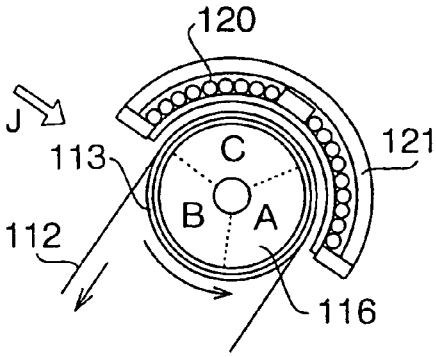
FIG. 15C is a cross-sectional drawing showing another operating mode of an image heating apparatus according to Embodiment 3 of the present invention.
Figure 16:
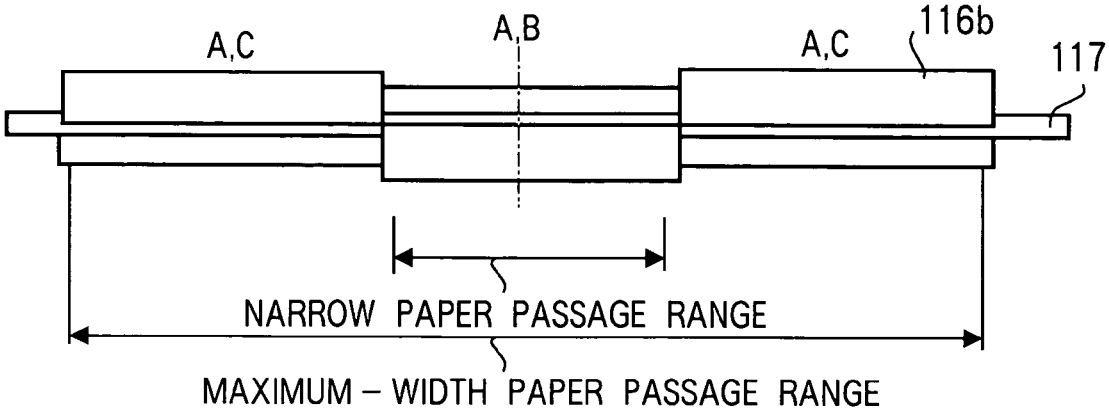
FIG. 16 is a configuration drawing of a magnetic flux adjustment section viewed from the direction indicated by arrow J in FIG. 15C.

FIG. 15A, FIG. 15B, and FIG. 15C are cross-sectional drawings of the heat-producing section of a fixing unit 19 in an image heating apparatus according to Embodiment 3 of the present invention, and FIG. 16 is a configuration drawing of opposed core 116 constituting a magnetic flux adjustment section viewed from the direction indicated by arrow J in FIG. 15C.

An image heating apparatus according to Embodiment 3 differs from an image heating apparatus according to Embodiment 1 in the configuration of the heat production adjustment section. That is to say, in an image heating apparatus according to Embodiment 3, opposed core 116 does not rotate continuously, but rotates between predetermined rotational positions when calorific value distribution switching is performed. Exciting coil 120 operates continuously when heating is performed.

Also, in an image heating apparatus according to Embodiment 3, the modes in which areas A, B, and C are formed with virtually cylindrical opposed core 116 divided into three equal parts with circular cross-sections are basically different. Here, in area A opposed core 116 spans the full width of the axial direction, in area B opposed core 116 spans only a range corresponding to the center narrow paper passage area, and in area C opposed core 116 spans only ranges corresponding to the narrow paper non-passage areas at both ends.

Other details are similar to those of an image heating apparatus according to Embodiment 1, and configuration members in this embodiment that have the same action as in Embodiment 1 are assigned the same codes as in Embodiment 1, and detailed descriptions thereof are omitted.

The operation and action of opposed core 116 as a heat production adjustment section in an image heating apparatus according to Embodiment 3 will now be described with reference to FIG. 15A, FIG. 15B, and FIG. 15C.

First, it is assumed that the temperature difference between center temperature sensor 118 and end temperature sensor 132 is less than a predetermined temperature difference (for example, 15° C.) . Also, it is assumed that the temperature measured by temperature sensor 132 is lower than a first predetermined temperature (for example, 180° C.) that is higher than the fixing temperature (for example, 170° C.). In this case, area A of opposed core 116 is positioned and fixed opposite exciting coil 120 as shown in FIG. 15A. At this time, parts of area B and area C are opposite exciting coil 120, and the opposed ranges of both areas are made the same.

When current is passed through exciting coil 120 in this state, magnetic flux acts uniformly upon the entire axial-direction width of fixing belt 112, and induction heating is performed uniformly. When recording paper 16 fed through is wide, heat is absorbed over virtually the entire width, and therefore the temperature of fixing belt 112 is maintained uniformly over its entire width.

When narrow recording paper 16 is passed through in the state shown in FIG. 15A, heat of only the center part of fixing belt 112 is absorbed by recording paper 16, and since temperature control is performed based on center temperature sensor 118, the temperature of both end parts, which are paper non-passage areas, rises.

When the temperature measured by temperature sensor 132 exceeds 180° C., opposed core 116 is rotated and area B and part of area A are positioned and fixed opposite exciting coil 120 as shown in FIG. 15B.

In this state in which mainly area B is opposite exciting coil 120, the distance between a part of fixing belt 112 corresponding to a paper non-passage area and opposed core 116 becomes greater than the distance from the center paper passage area. Consequently, the magnetic coupling between fixing belt 112 and exciting coil 120 in the paper non-passage areas becomes poorer than for the paper passage area, and therefore magnetic flux from exciting coil 120 acting upon fixing belt 112 in the paper non-passage areas decreases. As a result, calorific value distribution of the narrow paper non-passage areas declines, and an excessive rise in the temperature of the paper non-passage areas can be prevented.

Then, when the temperature measured by temperature sensor 132 becomes a second predetermined temperature (for example, 160° C.) that is lower than the fixing temperature, area A is positioned and fixed opposite exciting coil 120 as shown in FIG. 15A, and uniform calorific value distribution is restored.

If a printing operation is performed with narrow paper when fixing unit 19 is cold (for example, at room temperature), heating is started in the state shown in FIG. 15B in order to heat only the center part of fixing belt 112. In this case, since only the center part of fixing belt 112 is heated, the thermal capacity for heat production decreases. Therefore, in this case, the temperature can be raised to the predetermined temperature (170° C.) with little energy, and if heating is performed with the same power, the temperature can be raised in a short time.

In this case, the temperature of fixing belt 112 in the paper non-passage areas does not rise to the fixing temperature, and it is therefore possible to prevent the temperature of pressure roller 115 in the paper non-passage areas from becoming excessively higher than in the paper passage area.

Furthermore, in this case a state is established in which the temperature of center temperature sensor 118 is higher than that of end temperature sensor 132. If wide paper is next to be fed through in this state, it is necessary to heat only both end parts. In this case, area C and part of area A are positioned and fixed opposite exciting coil 120 as shown in FIG. 15C. In the calorific value distribution in this state, the calorific value of the center of fixing belt 112 is small, and the calorific value of the end parts is large. By this means it is possible to move from a state in which the temperature of the end parts is low to a state of uniform calorific value distribution. At this time, the temperature of the paper non-passage areas of pressure roller 115 has not risen excessively, and therefore, even when wide paper is fed through, it is possible to prevent irregularities such as uneven glossiness of a fixed image caused by nonuniformity of the temperature of pressure roller 115, enabling high-quality images to be obtained.

This state illustrated in FIG. 15C can be employed when the temperature of center temperature sensor 118 shows at least a predetermined temperature difference (for example, 15° C.) from that of end temperature sensor 132.

As described above, according to an image heating apparatus of Embodiment 3, the calorific value distribution of fixing belt 112 can be kept constantly virtually uniform even when narrow paper is continuously fed through. Therefore, fixing defects such as cold offset or hot offset due to nonuniformity of fixing calorific value distribution can be prevented when wide paper is fed through immediately after narrow paper is fed through, or when narrow paper and wide paper are fed through alternately.

Also, with this image heating apparatus, when starting up for narrow paper printing it is possible to heat only the center part, enabling the temperature to be raised with little energy, and also enabling the temperature to be raised in a short time if heating is performed with the same power. Furthermore, uniform calorific value distribution can be restored when the temperature of the end parts has become too low relative to that of the center part through heat dissipation to the end parts or the like.

Also, with this image heating apparatus, the proportions of strong heat-producing and weak heat-producing areas in the circumferential direction are uniform in the axial direction, enabling uniform full-width heating to be achieved when the entire width of fixing belt 112 is heated. Moreover, with this image heating apparatus, since opposed core 116 has a continuous area in the axial direction, fixing belt 112 can be heated uniformly and efficiently by positioning this part opposite exciting coil 120.

Furthermore, with this image heating apparatus, as opposed core 116 is rotated as an integral unit, the mechanism for rotational drive is simple.

EMBODIMENT 4

Figure 17:
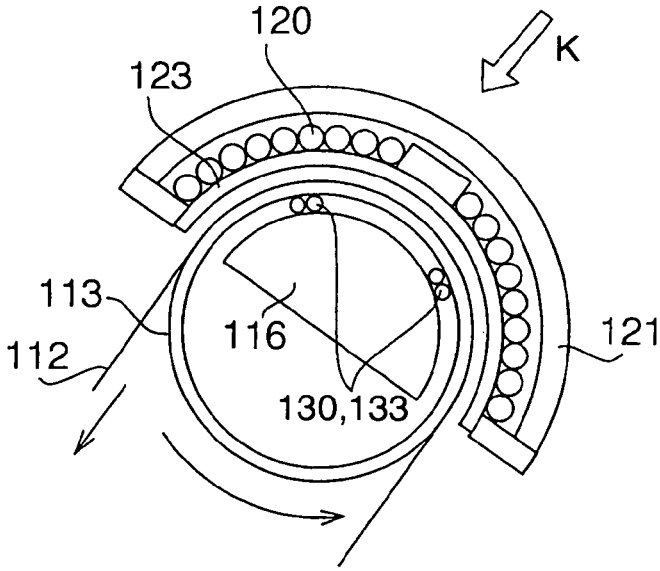
FIG. 17 is a cross-sectional drawing of an image heating apparatus according to Embodiment 4 of the present invention.
Figure 18:
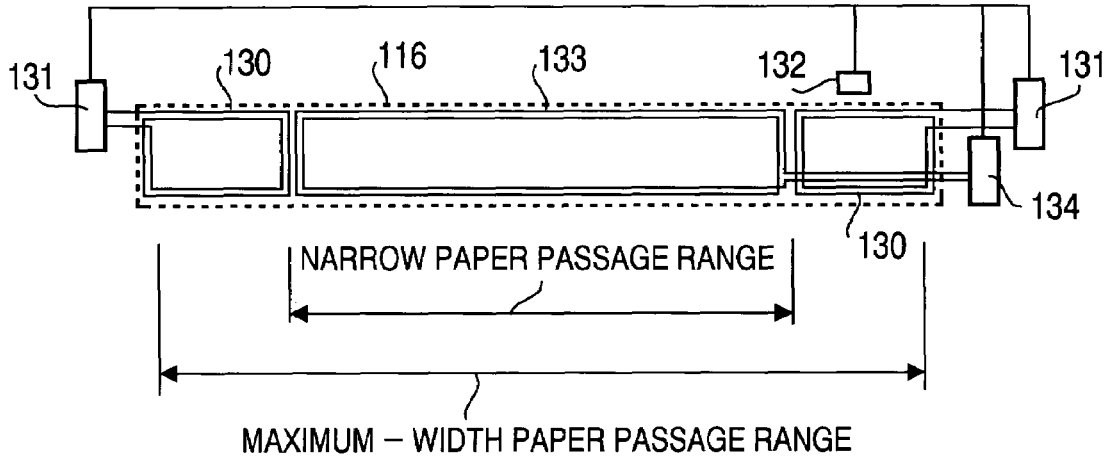
FIG. 18 is a configuration drawing of a magnetic flux adjustment section viewed from the direction indicated by arrow K in FIG. 17.

FIG. 17 is a cross-sectional drawing of the heat-producing section of a fixing unit 19 in an image heating apparatus according to Embodiment 4 of the present invention, and FIG. 18 is a configuration drawing of opposed core 116 constituting a magnetic flux adjustment section viewed from the direction indicated by arrow K in FIG. 17.

An image heating apparatus according to Embodiment 4 differs from an image heating apparatus according to Embodiment 3 in the configuration of the heat production adjustment section.

That is to say, in an image heating apparatus according to Embodiment 4, a 2-turn suppression coil 130 of litz wire is provided in the part opposite exciting coil 120 in the narrow paper non-passage areas at either end of opposed core 116.

Also provided are relays 131 serving as switching sections that perform electrical on/off switching of either end of suppression coils 130.

Furthermore, a 2-turn suppression coil 133 of litz wire is provided in the part opposite exciting coil 120 in the narrow paper passage area in the center of opposed core 116, and a relay 134 serving as a switching section that performs electrical on/off switching of either end of suppression coil 133 is also provided.

In an image heating apparatus according to Embodiment 4, opposed core 116 is supported fixedly and not rotated, and has a uniformly semicircular cross-sectional shape in the axial direction.

In an image heating apparatus according to Embodiment 4, relays 131 are opened and closed based on a temperature signal from temperature sensor 132 that measures the temperature of fixing belt 112 outside the narrow paper passage area and within the maximum-width paper passage area.

Other details are similar to those of an image heating apparatus according to Embodiment 3, and configuration members in this embodiment that have the same action as in Embodiment 3 are assigned the same codes as in Embodiment 3, and detailed descriptions thereof are omitted.

An image heating apparatus according to Embodiment 4 has suppression coils 130 as heat production adjustment sections. Both ends of suppression coils 130 are connected electrically by relays 131. Relays 131 have a switching element such as a power transistor and a contact.

In FIG. 18, when relays 131 are placed in the connected state, an induction current flows in suppression coils 130 in the direction in which it cancels out magnetic field variations due to the high-frequency current of exciting coil 120. Consequently, magnetic flux for induction heating of the end parts decreases, and the calorific value distribution of these parts declines.

On the other hand, when relay 134 is placed in the connected state, the calorific value distribution of the center part of fixing belt 112 declines.

If the temperature measured by temperature sensor 132 is lower than a first predetermined temperature (for example, 180° C.) that is higher than the fixing temperature (for example, 170° C.), relays 131 and 134 are placed in the open state. In this state, current does not flow in suppression coils 130 and 133, resulting in canceling-out of magnetic flux due to exciting coil 120, and enabling the entire width of fixing belt 112 to be heated uniformly and efficiently.

On the other hand, if the temperature measured by narrow paper non-passage area temperature sensor 132 is higher than 180° C. due to continuous passage of narrow paper or the like, each relay 131 is placed in the conducting state. In this state, an induction current flows in the direction in which it cancels out variations in magnetic flux linked to suppression coil 130. Therefore, magnetic flux can no longer pass through the interior of suppression coil 130, and magnetic flux from exciting coil 120 acting upon fixing belt 112 in the area in which suppression coil 130 is located decreases. As a result, in this image heating apparatus, the calorific value distribution of narrow paper non-passage areas declines, and an excessive rise in the temperature of the paper non-passage areas can be prevented.

Then, when the temperature measured by temperature sensor 132 becomes a second predetermined temperature (for example, 160° C.) that is lower than the fixing temperature, relays 131 are placed in the open state and uniform calorific value distribution is restored.

If a printing operation is performed with narrow paper when fixing unit 19 is cold (for example, at room temperature), heating is started with relays 131 in the connected state in order to heat only the center part. In this case, since only the center part is heated, the thermal capacity for heat production decreases. Therefore, in this case, the temperature can be raised to the predetermined temperature (170° C.) with little energy, and if heating is performed with the same power, the temperature can be raised in a short time.

In this case, also, the temperature of fixing belt 112 in the paper non-passage areas does not rise to the fixing temperature, and it is therefore possible to prevent the temperature of pressure roller 115 in the paper non-passage areas from becoming excessively higher than in the paper passage area.

Furthermore, in this case a state is established in which the temperature of center temperature sensor 118 is higher than that of end temperature sensor 132. If wide paper is next to be fed through in this state, it is necessary to heat only both end parts. In this case, exciting coil 120 is driven with relay 134 in the connected state. In the calorific value distribution in this state, the calorific value of the center part is small, and the calorific value of the end parts is large. By this means it is possible to move from a state in which the temperature of the end parts is low to a state of uniform calorific value distribution. At this time, the temperature of the paper non-passage areas of pressure roller 115 has not risen excessively, and therefore, even when wide paper is fed through, it is possible to prevent irregularities such as uneven glossiness of a fixed image caused by nonuniformity of the temperature of pressure roller 115, enabling high-quality images to be obtained.

Relay 134 can be operated when the temperature of center temperature sensor 118 shows at least a predetermined temperature difference (for example, 15° C.) from that of end temperature sensor 132.

As described above, according to an image heating apparatus of Embodiment 4, the calorific value distribution of fixing belt 112 can be kept constantly virtually uniform even when narrow paper is continuously fed through without the provision of a mechanical movable section. Therefore, with this image heating apparatus, it is possible to prevent the generation of abnormal noises, rotation sounds, and sliding sounds due to mechanical movement switching. Furthermore, with this image heating apparatus, fixing defects such as cold offset or hot offset due to nonuniformity of fixing calorific value distribution can be prevented when wide paper is fed through immediately after narrow paper is fed through, or when narrow paper and wide paper are fed through alternately.

Also, with this image heating apparatus, when starting up for narrow paper printing, it is possible to heat only the center part, enabling the temperature to be raised with little energy, and also enabling the temperature to be raised in a short time if heating is performed with the same power. Furthermore, with this image heating apparatus, uniform calorific value distribution can be restored when the temperature of the end parts has become too low relative to that of the center part through heat dissipation to the end parts or the like.

Moreover, with this image heating apparatus, since opposed core 116 is used on the opposite side of suppression coils 130 from fixing belt 112, the magnetic coupling between exciting coil 120, fixing belt 112, and suppression coils 130 is improved, enabling the suppression coil calorific value distribution adjustment action through opening and closing of relays 131 to be made sufficiently great. Also, with this image heating apparatus, the suppression coil calorific value distribution adjustment action through opening and closing of relays 131 can be further increased by installing part of opposed core 116 inside suppression coils 130.

In this image heating apparatus, an opposed core 116 is located on the opposite side of suppression coils 130 from fixing belt 112, but it is also possible to implement a configuration in which no opposed core 116 is provided. In the case of an image heating apparatus configured without an opposed core 116, the use of an expensive and heavy material such as ferrite is not necessary, enabling the apparatus to be made less expensive and lighter.

In this image heating apparatus, suppression coils 130 and 133 are installed in the same axial direction, enabling even minute effects of the wiring of suppression coils 130 and 133 on excitation flux with relays 131 and 134 in the open state to be made uniform in the axial direction. By this means, with this image heating apparatus, the entire width of fixing belt 112 can be heated uniformly by placing relays 131 and 134 in the open state.

With this image heating apparatus, suppression coils 130 are not limited to an above-described wire material wound around a plurality of times. For example, the same kind of effect can be obtained with a configuration in which a thin metal sheet is formed into a single loop. This configuration does not require multiple windings of wire, enabling the manufacturing process to be simplified.

It is not necessary for the installation range of suppression coils 130 to provide for the width of narrow paper fed through. Setting may be performed in a range greater than the width of narrow paper and less than the maximum paper width, taking into consideration the amount of heat lost by heat transfer from both ends via the bearings.

The loop formation direction of suppression coils 130 is not limited to that shown in this embodiment, the only requirement being linkage to magnetic flux from exciting coil 120.

EMBODIMENT 5

Figure 19:
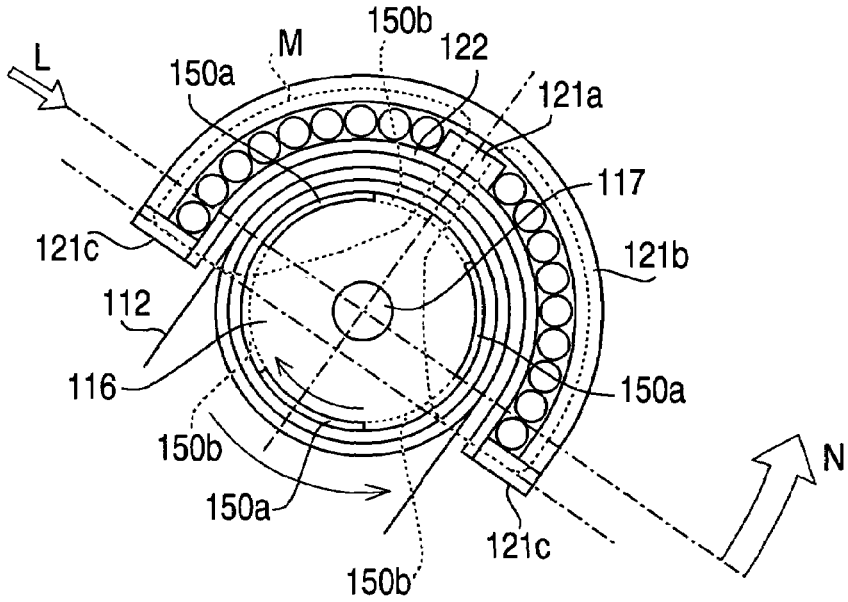
FIG. 19 is a cross-sectional drawing of an image heating apparatus according to Embodiment 5 of the present invention.
Figure 20:
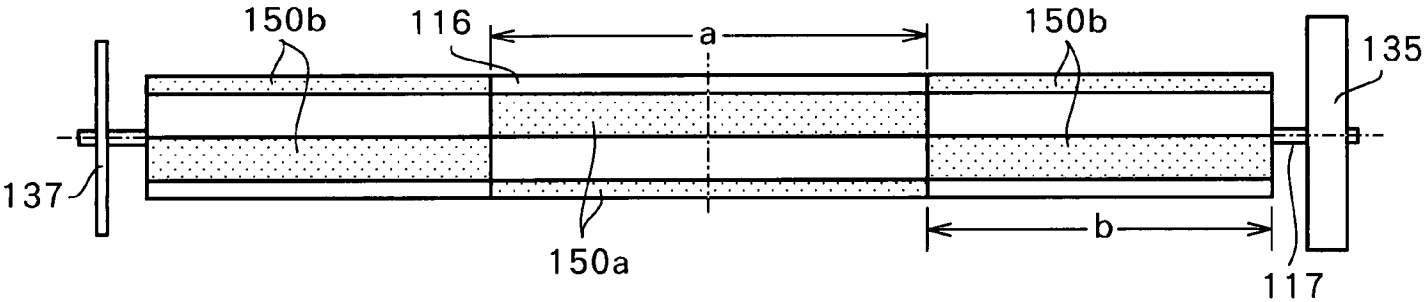
FIG. 20 is a configuration drawing of a magnetic flux adjustment section viewed from the direction indicated by arrow L in FIG. 19.
Figure 21:
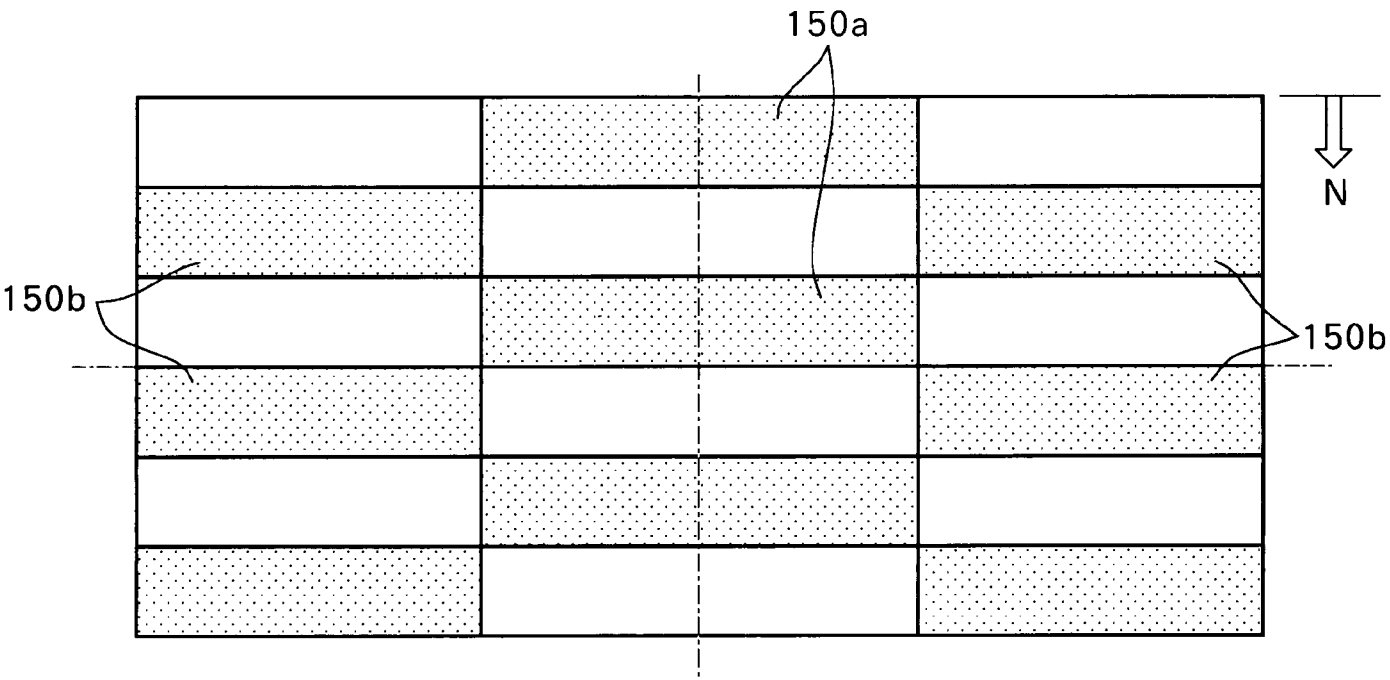
FIG. 21 is a surface development drawing of the magnetic flux adjustment section shown in FIG. 19.

FIG. 19 is a cross-sectional drawing of the center part of the heat-producing section of a fixing unit 19 according to Embodiment 5 of the present invention, FIG. 20 is a configuration drawing of opposed core 116 constituting a magnetic flux adjustment section viewed from the direction indicated by arrow L in FIG. 19, and FIG. 21 is a development drawing of the surface of opposed core 116 rotated in the direction indicated by arrow N with the base of arrow N as the starting point.

An image heating apparatus according to Embodiment 5 differs from an image heating apparatus according to Embodiment 2 in the configuration of opposed core 116 functioning as a heat production adjustment section. That is to say, in an image heating apparatus according to Embodiment 5 a plurality of suppression members 150*a* and 150*b* functioning as magnetic flux adjustment elements of a nonmagnetic conductive material such as aluminum are provided on the peripheral surface of opposed core 116 comprising a cylindrical body functioning as the aforementioned heat production adjustment section. Recesses corresponding to suppression members 150*a* and 150*b* are provided in opposed core 116, and the outer peripheral surface of other parts of opposed core 116 are made the same circumferential surface as the outer peripheral surface of suppression members 150*a* and 150*b*.

Suppression members 150*a* are paper passage area magnetic flux adjustment elements that adjust the magnetic flux of the paper passage area of opposed core 116. Suppression members 150*b* are paper non-passage area magnetic flux adjustment elements that adjust the magnetic flux of paper non-passage areas of opposed core 116.

With an image heating apparatus according to Embodiment 5, the excitation operation timing of exciting coil 120 with respect to the rotational phase of opposed core 116 is controlled in accordance with the width of recording paper 16 fed through.

Other details are similar to those of an image heating apparatus according to Embodiment 2, and configuration members in this embodiment that have the same action as in Embodiment 2 are assigned the same codes as in Embodiment 2, and detailed descriptions thereof are omitted.

As shown in FIG. 19 and FIG. 20, suppression members 150*a* and 150*b* are positioned alternately in the circumferential direction of the surface of opposed core 116. In FIG. 20, the center part in which a plurality of suppression members 150*a* are located is designated area a, and the two end parts in which a plurality of suppression members 150*b* are located are designated areas b.

Next, a description will be given of the operation and action of opposed core 116 as a heat production adjustment section in an image heating apparatus according to Embodiment 5.

In FIG. 19, when an area of opposed core 116 in which suppression members 150*a* and 150*b* are absent is opposite center core 121*a*, magnetic flux M permeates fixing belt 112 from center core 121*a*. This magnetic flux M passes through the interior of opposed core 116 positioned inside suppression members 150*a* and 150*b*, and permeates fixing belt 112 again. Then a magnetic path passing through arch cores 121*b* from side cores 121*c* and returning to center core 121*a* is created. By this means, the permeability of the area through which magnetic flux M generated by exciting coil 120 by means of the alternating current from excitation circuit 123 passes increases. As the magnetoresistance of this area falls, magnetic coupling between exciting coil 120 and fixing belt 112 improves. Therefore, the calorific value distribution of this part of fixing belt 112 can be increased.

On the other hand, when an area in which suppression members 150*a* and 150*b* intermediate with respect to the surface of opposed core 116 is opposite center core 121*a*, an eddy current is induced in suppression members 150*a* and 150*b*, and variation of the magnetic flux passing through suppression members 150*a* and 150*b* is prevented. Through this action, magnetic flux acting upon fixing belt 112 in a paper non-passage area from exciting coil 120 can be greatly reduced. By this means, the heating width of fixing belt 112 can be controlled in accordance with the width of recording paper 16 fed through.

That is to say, with this image heating apparatus, when exciting coil 120 is excited at a rotational phase at which suppression members 150*b* at either end of opposed core 116 are opposite center core 121*a*, the central narrow paper passage area part of fixing belt 112 is strongly heated.

On the other hand, when exciting coil 120 is excited at a rotational phase at which a suppression member 150*a* in the center of opposed core 116 is opposite center core 121*a*, the narrow paper non-passage areas at the ends of fixing belt 112 are strongly heated.

Thus, in an image heating apparatus according to Embodiment 5, the calorific value distribution of fixing belt 112 is adjusted by rotating opposed core 116 continuously and adjusting the operation timing of exciting coil 120 in accordance with the rotational phase of opposed core 116.

Figure 22:
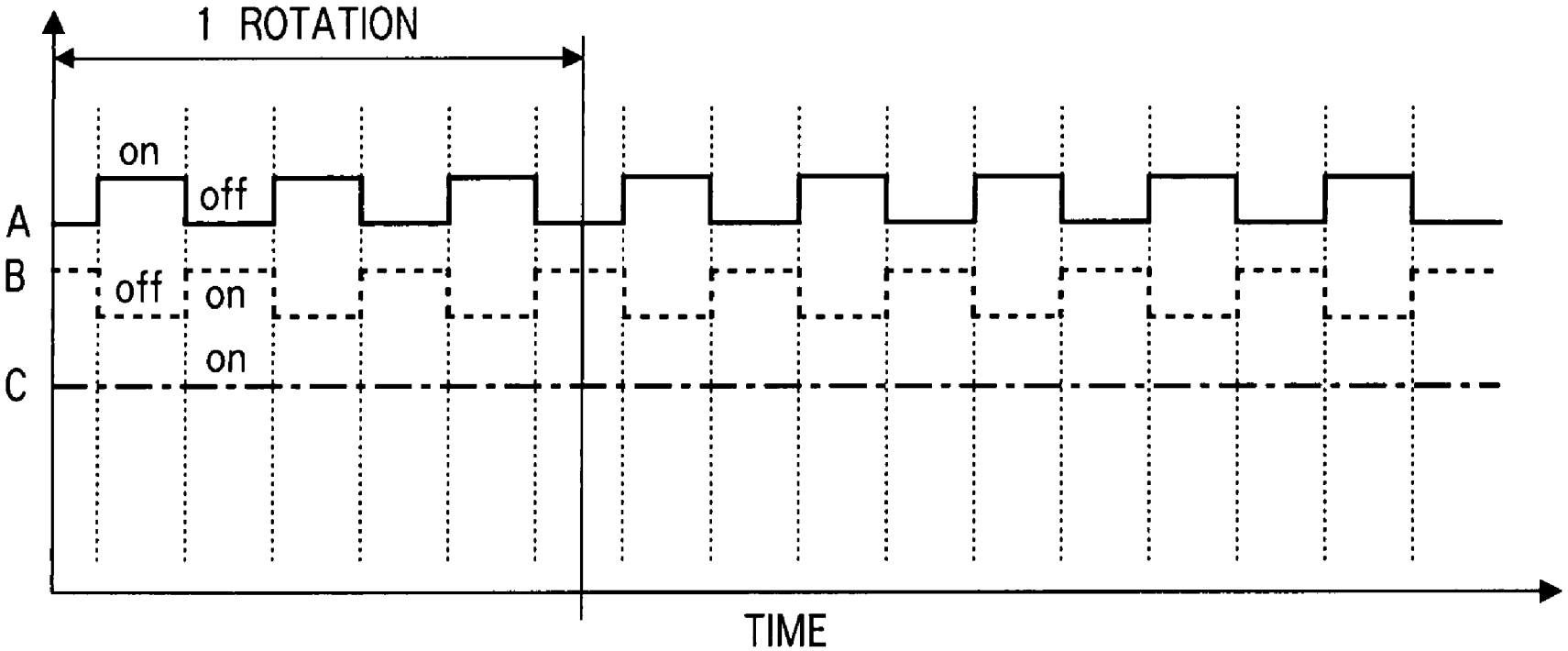
FIG. 22 is an explanatory drawing showing the excitation operation patterns of an exciting coil in an image heating apparatus according to Embodiment 5 of the present invention.

FIG. 22 shows an example of the rotational phases of opposed core 116 and the operation timing and excitation operation patterns of exciting coil 120 in an image heating apparatus according to Embodiment 5. In FIG. 22, excitation operation pattern A is used when heating only the center part of fixing belt 112, excitation operation pattern B is used when heating only both end parts of fixing belt 112, and excitation operation pattern C is used when heating the entire width of fixing belt 112.

Switching of the rotational phase of opposed core 116 and the operation timing and excitation operation pattern of exciting coil 120 is similar to that in an image heating apparatus according to Embodiment 2, but as there are a plurality n of suppression members 150*a* and 150*b* on the circumferential surface, the number of switching operations per rotation is n times that in Embodiment 5.

Thus, according to an image heating apparatus of Embodiment 5, any part of fixing belt 112 can be heated selectively by operating exciting coil 120 based on predetermined timing in accordance with the rotational phase of opposed core 116.

Therefore, with this image heating apparatus, the temperature of fixing belt 112 can be controlled uniformly and with a high degree of precision.

The positional relationship and magnetoresistance relationship between suppression members 150*a* and 150*b* of opposed core 116 and center core 121*a* are the same as for the positional relationship between suppression members 150*a* and 150*b* of opposed core 116 and side cores 121*c*. Therefore, to increase magnetic flux M magnetoresistance variations, when an area in which suppression members 150*a* and 150*b* of opposed core 116 are absent is opposite center core 121*a*, it is desirable for an area in which side cores 121*c* or suppression members 150*a* and 150*b* of opposed core 116 are absent to be opposite. Consequently, in this embodiment in which there are three suppression members 150*a* and 150*b* on the circumference, arch cores 121*b* are extended and the position of side cores 121*c* is displaced in the direction of the center position of an area in which suppression members 150*a* and 150*b* of opposed core 116 are absent as shown in FIG. 19.

With this image heating apparatus, high-quality images can be obtained without reducing throughput even if wide recording paper 16 and narrow recording paper 16 are alternately fed through continuously.

Also, with this image heating apparatus, opposed core 116 functioning as the above-described magnetic flux adjustment section can be configured inexpensively and simply.

Furthermore, with this image heating apparatus, since a plurality of suppression members 150*a* and 150*b* are provided, these suppression members 150*a* and 150*b* and center core 121*a* can be positioned opposite each other in a short time, and heat production irregularities in the circumferential direction of fixing belt 112 can be reduced.

Moreover, with this image heating apparatus, it is possible to vary the heating temperature of fixing belt 112 selectively by making the electromagnetic characteristics of suppression members 150*a* and 150*b* different.

In Embodiment 5, a plurality of suppression members 150*a* and 150*b* are provided in the circumferential direction of opposed core 116 as magnetic flux adjustment elements, but the same kind of effect can also be obtained by a configuration providing a plurality of notches or adjustment members 138 in notch parts of opposed core 116 as shown in Embodiment 1.

EMBODIMENT 6

Figure 23:
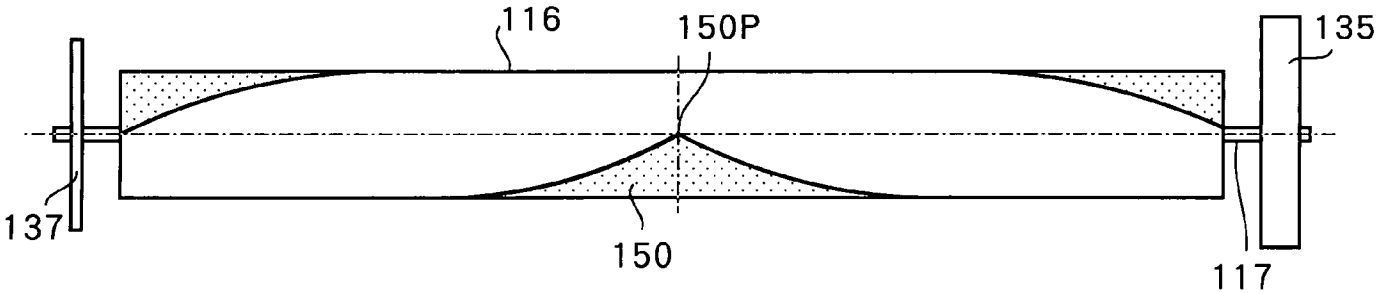
FIG. 23 is a configuration drawing of a magnetic flux adjustment section in an image heating apparatus according to Embodiment 6 of the present invention.
Figure 24:
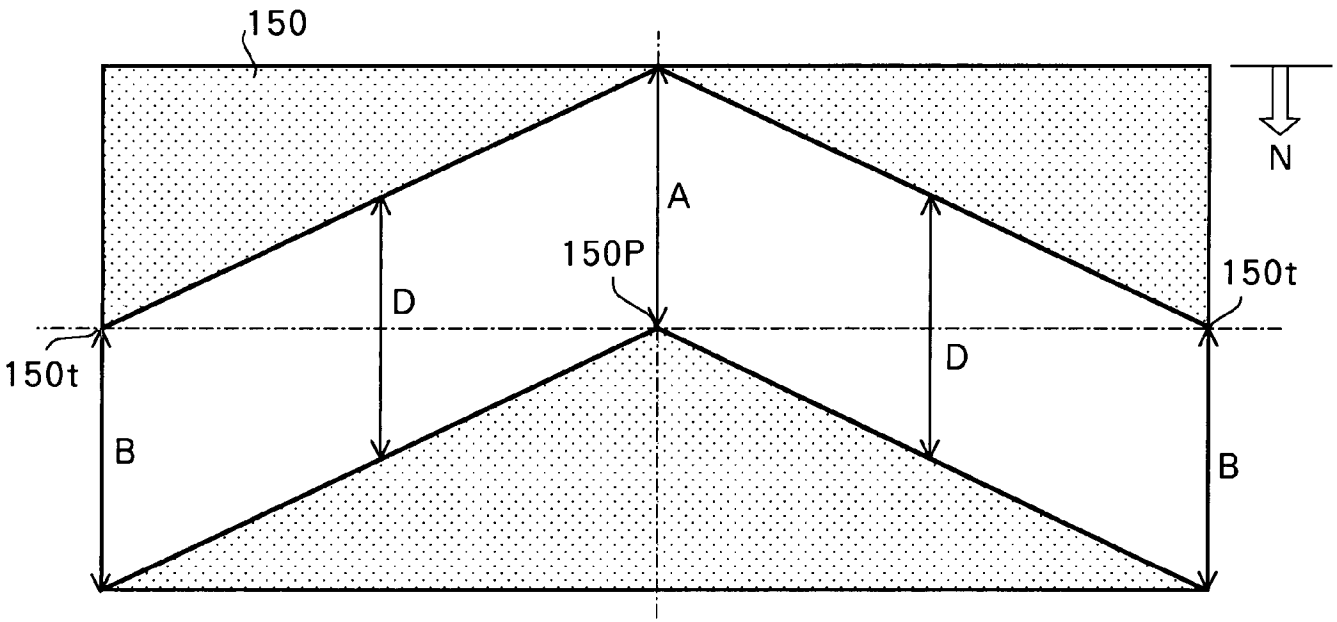
FIG. 24 is a surface development drawing of the magnetic flux adjustment section shown in FIG. 23.

FIG. 23 is a configuration drawing of opposed core 116 constituting a magnetic flux adjustment section viewed from the direction indicated by arrow L in FIG. 13, and FIG. 24 is a development drawing of the surface of opposed core 116 rotated in the direction indicated by arrow N with the base of arrow N as the starting point.

An image heating apparatus according to Embodiment 6 differs from an image heating apparatus according to Embodiment 2 in the configuration of opposed core 116 functioning as a heat production adjustment section.

That is to say, in an image heating apparatus according to Embodiment 6 a suppression member 150 functioning as a magnetic flux adjustment element of a nonmagnetic conductive material such as aluminum is wound helically halfway around the perimeter across the entire peripheral surface of opposed core 116 comprising a cylindrical body functioning as the aforementioned heat production adjustment section.

In other words, with an image heating apparatus according to Embodiment 6, a configuration is employed in which the upstream end 150*p* of chevron-shaped suppression member 150 is located in the center of opposed core 116, and downstream ends 150*t* of suppression member 150 are located at either end of opposed core 116.

In an image heating apparatus according to Embodiment 6, the excitation operation timing of exciting coil 120 with respect to the rotational phase of opposed core 116 is controlled in accordance with the temperature distribution of fixing belt 112.

Other details are similar to those of an image heating apparatus according to Embodiment 2, and configuration members in this embodiment that have the same action as in Embodiment 2 are assigned the same codes as in Embodiment 2, and detailed descriptions thereof are omitted.

Next, a description will be given of the operation and action of opposed core 116 as a heat production adjustment section in an image heating apparatus according to Embodiment 6.

In FIG. 24, when an area of opposed core 116 in which suppression member 150 is absent is opposite fixing belt 112, the permeability of the area through which magnetic flux passes increases. As the magnetoresistance of this area falls, magnetic coupling between exciting coil 120 and fixing belt 112 improves. Therefore, the calorific value distribution of this part of fixing belt 112 can be increased.

On the other hand, when suppression member 150 intermediates with respect to the surface of opposed core 116, an eddy current is induced in suppression member 150, and variation of the magnetic flux passing through suppression member 150 is prevented. Through this action, magnetic flux acting upon fixing belt 112 in an area in a recording paper 16 non-passage area from exciting coil 120 can be greatly reduced. By this means, the heating width of fixing belt 112 can be controlled arbitrarily in accordance with the temperature distribution of fixing belt 112.

That is to say, with this image heating apparatus, when exciting coil 120 is excited at a rotational phase at which an area in which suppression member 150 in the width-direction center part of opposed core 116 indicated by arrow A in FIG. 24 is absent is opposite exciting coil 120, only the center part of fixing belt 112 is strongly heated. Similarly, when exciting coil 120 is excited at a rotational phase at which areas in which suppression member 150 at either end of opposed core 116 in the width direction indicated by arrows B in FIG. 24 is absent are opposite exciting coil 120, only both end parts of fixing belt 112 are strongly heated. Furthermore, when exciting coil 120 is excited at a rotational phase at which areas in which suppression member 150 in intermediate areas between the width-direction center part and end parts of opposed core 116 indicated by arrows D in FIG. 24 is absent are opposite exciting coil 120, only intermediate areas between the width-direction center part and end parts of fixing belt 112 are strongly heated.

Therefore, if exciting coil 120 is excited with the rotational phase of an area of opposed core 116 in which suppression member 150 opposite fixing belt 112 is absent aligned with the width-direction position of fixing belt 112 that it is wished to cause to produce heat, an arbitrary area of fixing belt 112 can be heated.

Thus, in an image heating apparatus according to Embodiment 6, the calorific value distribution of fixing belt 112 is adjusted by rotating opposed core 116 continuously and adjusting the operation timing of exciting coil 120 in accordance with the rotational phase of opposed core 116 and the temperature distribution of fixing belt 112.

Figure 25A:
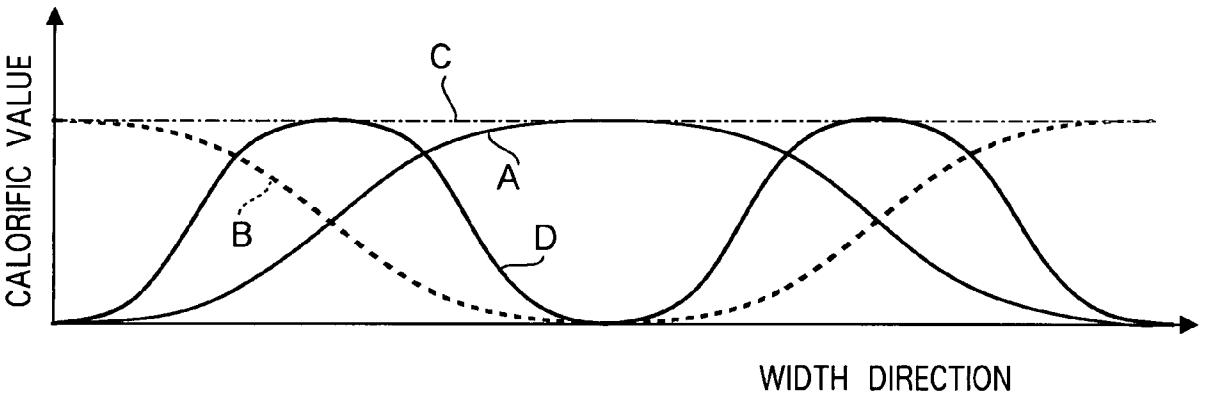
FIG. 25A is a graph showing calorific value distributions of a heat-producing medium when using the magnetic flux adjustment section shown in FIG. 23.
Figure 25B:
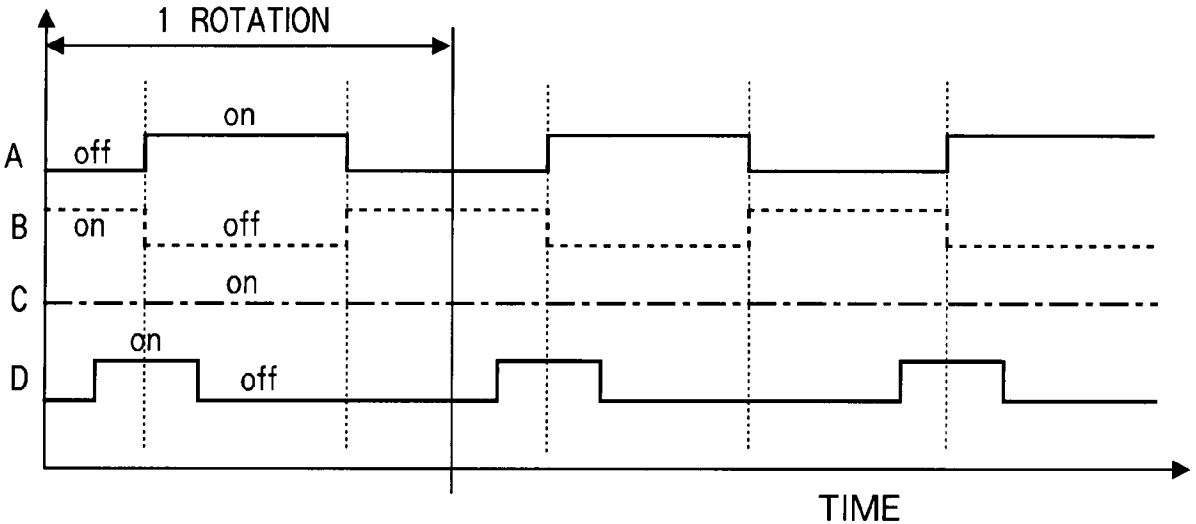
FIG. 25B is an explanatory drawing showing the excitation operation patterns of an exciting coil in an image heating apparatus according to Embodiment 6 of the present invention corresponding to the calorific value distributions shown in FIG. 25A.

FIG. 25A and FIG. 25B show examples of the rotational phases of opposed core 116 and the operation timing and excitation operation patterns of exciting coil 120 in an image heating apparatus according to Embodiment 6. In FIG. 25A and FIG. 25B, excitation operation pattern A is used when heating only the center part of fixing belt 112, excitation operation pattern B is used when heating only both end parts of fixing belt 112, excitation operation pattern C is used when heating the entire width of fixing belt 112, and excitation operation pattern D is used when heating intermediate areas between the width-direction center part and end parts of fixing belt 112.

Thus, according to an image heating apparatus of Embodiment 6, any part of fixing belt 112 can be heated selectively by operating exciting coil 120 based on predetermined timing in accordance with the rotational phase of opposed core 116.

Therefore, with this image heating apparatus, the heating temperature distribution of fixing belt 112 can be controlled uniformly and with a high degree of precision as shown in FIG. 25A.

Also, with this image heating apparatus, high-quality images can be obtained without reducing throughput even if wide recording paper 16 and narrow recording paper 16 are alternately fed through continuously.

EMBODIMENT 7

Figure 26:
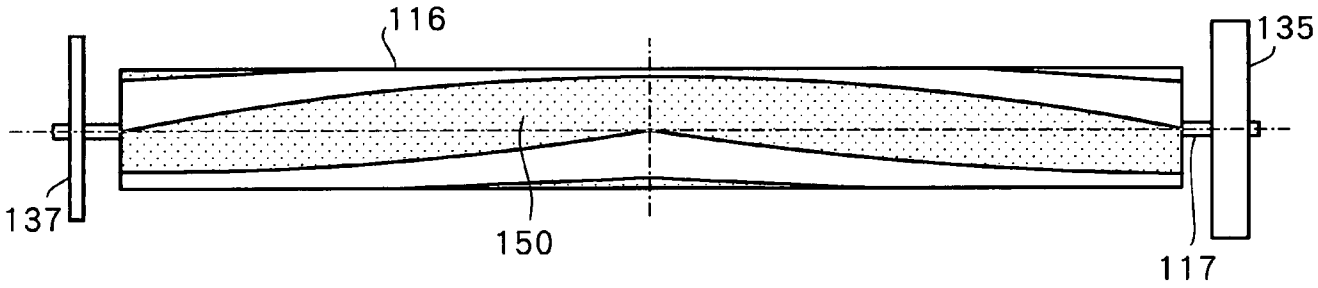
FIG. 26 is a configuration drawing of another magnetic flux adjustment section in an image heating apparatus according to Embodiment 6 of the present invention.
Figure 27:
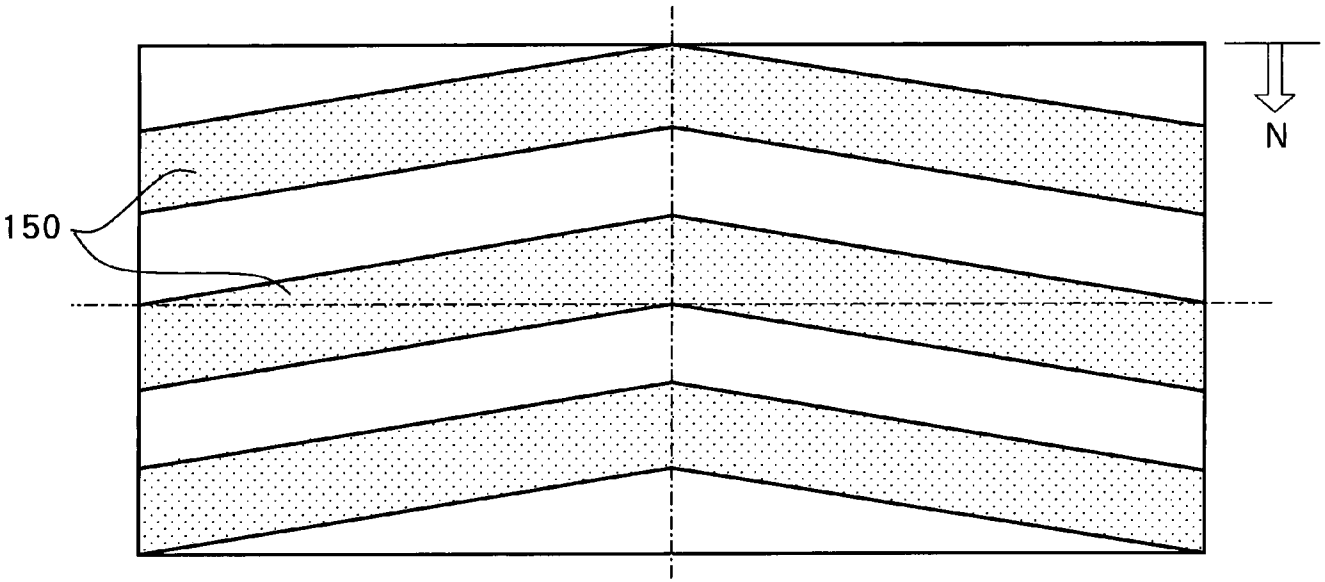
FIG. 27 is a surface development drawing of the magnetic flux adjustment section shown in FIG. 26.

FIG. 26 is a configuration drawing of another opposed core 116 constituting a magnetic flux adjustment section in an image heating apparatus according to Embodiment 7 viewed from the direction indicated by arrow L in FIG. 19, and FIG. 27 is a development drawing of the surface of this opposed core 116 rotated in the direction indicated by arrow N with the base of arrow N as the starting point.

A plurality of n chevron-shaped suppression members 150 functioning as magnetic flux adjustment elements of a non-magnetic conductive material such as aluminum are wound helically halfway around a 1/(2×n) part of the peripheral surface of opposed core 116.

Other details are similar to those of an image heating apparatus according to Embodiment 6, and configuration members in this embodiment that have the same action as in Embodiment 6 are assigned the same codes as in Embodiment 6, and detailed descriptions thereof are omitted.

Switching of the rotational phase of opposed core 116 and the operation timing and excitation operation pattern of exciting coil 120 is similar to that in an image heating apparatus according to Embodiment 6, but as there are a plurality n of suppression members 150 on the circumferential surface, the number of switching operations per rotation is n times that in Embodiment 7.

Figure 28A:
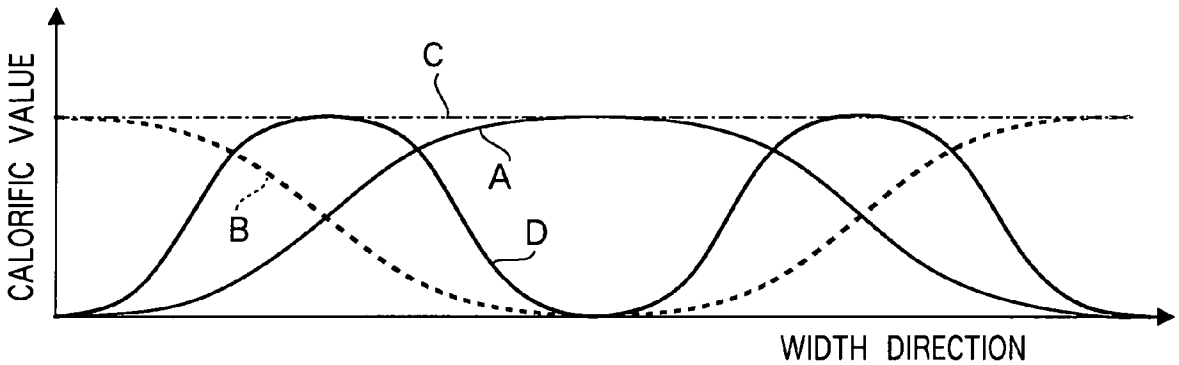
FIG. 28A is a graph showing calorific value distributions of a heat-producing medium when using the magnetic flux adjustment section shown in FIG. 26.
Figure 28B:
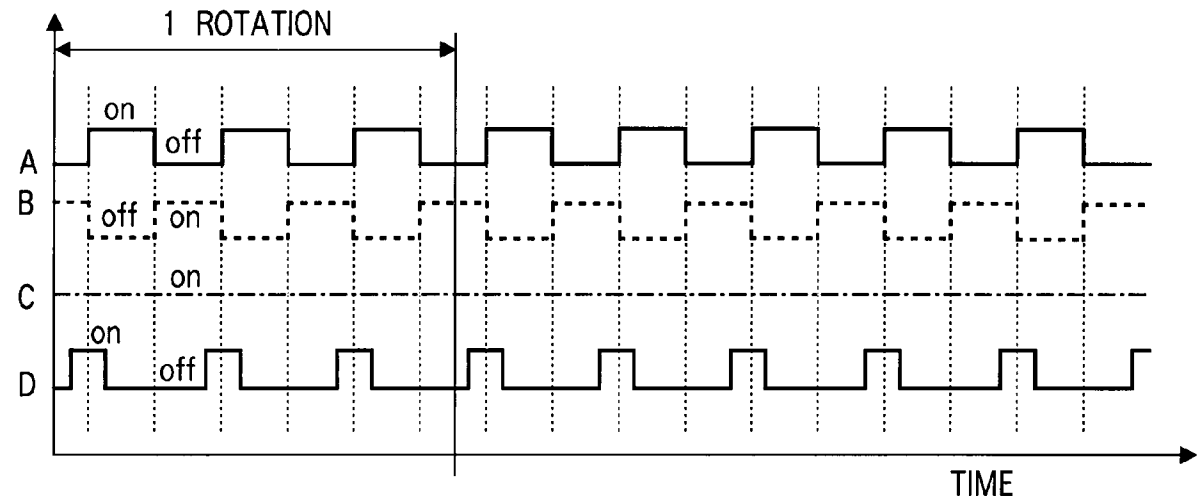
FIG. 28B is an explanatory drawing showing the excitation operation patterns of an exciting coil in an image heating apparatus according to Embodiment 7 of the present invention corresponding to the calorific value distributions shown in FIG. 28A.

FIG. 28A and FIG. 28B show examples of the rotational phases of this opposed core 116 and the operation timing and excitation operation patterns of exciting coil 120. In FIG. 28A and FIG. 28B, excitation operation pattern A is used when heating only the center part of fixing belt 112, excitation operation pattern B is used when heating only both end parts of fixing belt 112, excitation operation pattern C is used when heating the entire width of fixing belt 112, and excitation operation pattern D is used when heating intermediate areas between the width-direction center part and end parts of fixing belt 112.

Thus, according to an image heating apparatus that employs the opposed core 116 shown in FIG. 26, any part of fixing belt 112 can be heated selectively by operating exciting coil 120 based on predetermined timing in accordance with the rotational phase of opposed core 116.

Therefore, with this image heating apparatus, the heating temperature distribution of fixing belt 112 can be controlled uniformly and with a high degree of precision as shown in FIG. 28A.

Also, with this image heating apparatus, high-quality images can be obtained without reducing throughput even if wide recording paper 16 and narrow recording paper 16 are alternately fed through continuously.

Furthermore, with an image heating apparatus that employs the opposed core 116 shown in FIG. 26, since a plurality of suppression members 150 are provided, these suppression members 150 and center core 121*a* can be positioned opposite each other in a short time, and heat production irregularities in the circumferential direction of fixing belt 112 can be reduced.

Moreover, with this image heating apparatus, it is possible to vary the heating temperature of fixing belt 112 selectively by making the electromagnetic characteristics of individual suppression members 150 different.

EMBODIMENT 8

Figure 29:
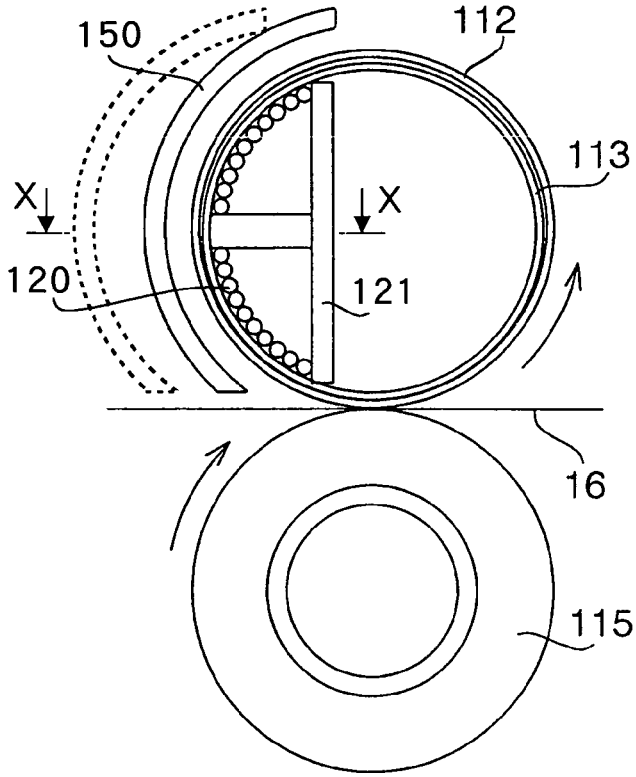
FIG. 29 is a cross-sectional drawing of an image heating apparatus according to Embodiment 8 of the present invention.
Figure 30:
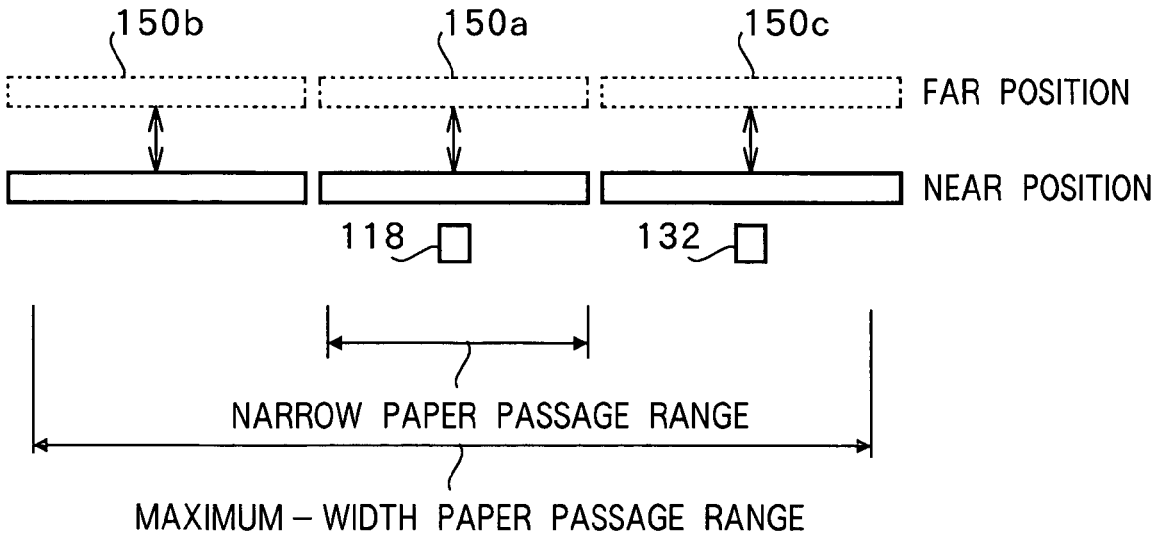
FIG. 30 is a cross-sectional drawing through line X-X of the magnetic flux absorption member shown in FIG. 29 provided in an image heating apparatus according to Embodiment 8 of the present invention.

FIG. 29 is a cross-sectional drawing of a fixing unit 19 functioning as an image heating apparatus according to Embodiment 8 of the present invention, and FIG. 30 is a cross-sectional drawing through line X-X of the magnetic flux absorption member shown in FIG. 29 provided in an image heating apparatus according to Embodiment 8.

An image heating apparatus according to Embodiment 8 differs from an image heating apparatus according to Embodiment 3 in the configuration of fixing unit 19. That is to say, in this image heating apparatus, exciting coil 120 is installed inside retaining roller 113 as shown in FIG. 29. With this image heating apparatus, also, retaining roller 113 is pressed against pressure roller 115 via fixing belt 112, and an approximately arc-shaped electric conductor serving as a suppression member 150 is positioned opposite and close to the outer peripheral surface of fixing belt 112.

Suppression member 150 is divided into three in the axial direction, being composed of a central suppression member 150*a* and two end suppression members 150*b*. The division locations correspond to the boundaries of a predetermined narrow recording paper 16 passage range. Suppression member 150 is made of 1.5 mm thick aluminum sheet.

Divided suppression members 150*a* and 150*b* are supported so as to be movable in the radial direction of fixing belt 112. Suppression members 150*a* and 150*b* move between a near position at a distance of 0.5 mm from fixing belt 112 and a far position at a distance of 4 mm from fixing belt 112.

Other details are similar to those of an image heating apparatus according to Embodiment 3, and configuration members in this embodiment that have the same action as in Embodiment 3 are assigned the same codes as in Embodiment 3, and detailed descriptions thereof are omitted.

Next, a description will be given of the operation and action of suppression member 150 as a heat production adjustment section in an image heating apparatus according to Embodiment 6.

It is assumed that the temperature difference between center temperature sensor 118 and end temperature sensor 132 is less than a predetermined temperature difference (for example, 15° C.) . Also, it is assumed that the temperature measured by temperature sensor 132 is lower than a first predetermined temperature (for example, 180° C.) that is higher than the fixing temperature (for example, 170° C.). In this case, both suppression member 150*a* and 150*b* are placed in the far positions shown by the dotted lines in FIG. 29 and FIG. 30. When current is passed through exciting coil 120 in this state, magnetic flux acts uniformly upon the entire axial-direction width of fixing belt 112, and induction heating is performed uniformly. When recording paper 16 fed through is wide, heat is absorbed over virtually the entire width, and therefore the temperature of fixing belt 112 is maintained uniformly over the entire width of fixing belt 112.

When narrow recording paper is passed through in this state, heat of only the center part is absorbed by recording paper 16, and since temperature control is performed based on center temperature sensor 118, the temperature of both end parts, which are paper non-passage areas, rises.

When the temperature measured by temperature sensor 132 exceeds 180° C., suppression members 150*b* at both ends are moved to the near positions shown by the solid lines in FIG. 29 and FIG. 30.

With suppression members 150*b* at both ends brought near to fixing belt 112 in this way, the magnetic coupling between fixing belt 112 and exciting coil 120 in the paper non-passage areas becomes poorer than for the paper passage area, and magnetic flux from exciting coil 120 acting upon fixing belt 112 in the paper non-passage areas decreases. As a result, calorific value distribution of the narrow paper non-passage areas declines, and an excessive rise in the temperature of the paper non-passage areas can be prevented.

Then, when the temperature measured by temperature sensor 132 becomes a second predetermined temperature (for example, 160° C.) that is lower than the fixing temperature, suppression members 150*b* at both ends are moved to their far positions and the temperature of fixing belt 112 is restored to a uniform calorific value distribution.

If a printing operation is performed with narrow paper when fixing unit 19 is cold (for example, at room temperature), only the center part of fixing belt 112 is heated. That is to say, in this case, heating is started with suppression members 150*b* at both ends positioned close to fixing belt 112.

In this case, since only the center part is heated with strong calorific value distribution, the thermal capacity during heating decreases. Therefore, with this image heating apparatus, the temperature can be raised to the predetermined temperature (170° C.) with little energy, and if heating is performed with the same power, the temperature can be raised in a short time.

In this case, a state is established in which the temperature of center temperature sensor 118 is higher than that of end temperature sensor 132. If wide paper is next to be fed through in this state, it is necessary to heat only both end parts of fixing belt 112.

Thus, in this case, center-part suppression member 150*a* is placed in the near position and end-part suppression members 150*b* are placed in the far position. In the calorific value distribution in this state, the calorific value of the center of fixing belt 112 is small, and the calorific value of the end parts is large.

By this means it is possible to move from a state in which the temperature of the end parts of fixing belt 112 is low to a state of uniform calorific value distribution. This calorific value distribution can be employed when the temperature of center temperature sensor 118 shows at least a predetermined temperature difference (for example, 15° C.) from that of end temperature sensor 132.

Also, with this image heating apparatus, by locating electrically conductive suppression member 150 on the outside of fixing belt 112, leakage of magnetic flux outside fixing unit 19 can be prevented.

As described above, with an image heating apparatus according to Embodiment 8, the calorific value distribution of fixing belt 112 can be kept constantly virtually uniform even when narrow paper is continuously fed through. Therefore, fixing defects such as cold offset or hot offset due to nonuniformity of fixing calorific value distribution can be prevented when wide recording paper 16 is fed through immediately after narrow recording paper 16 is fed through, or when narrow recording paper 16 and wide recording paper 16 are fed through alternately.

Also, with this image heating apparatus, when starting up for narrow recording paper 16 printing, it is possible to heat only the center part of fixing belt 112, enabling the temperature to be raised with little energy, and also enabling the temperature to be raised in a short time if heating is performed with the same power.

Furthermore, uniform calorific value distribution can be restored when the temperature of the end parts of fixing belt 112 has become too low relative to that of the center part through heat dissipation to the end parts or the like.

Moreover, with this image heating apparatus, in the far position suppression member 150 is placed in a far position whose distance is uniform in the axial direction, enabling full-width heating to be performed uniformly and efficiently when the entire width of fixing belt 112 is heated.

Although it is possible for suppression member 150 to be located between exciting coil 120 and fixing belt 112, in this image heating apparatus according to Embodiment 6 suppression member 150 is located on the opposite side of fixing belt 112 from exciting coil 120.

By this means, the current and voltage induced in suppression member 150 are made small, and a rise in the temperature of suppression member 150 is suppressed. As a result, in this image heating apparatus, induction heating energy consumed by suppression member 150 can be suppressed, enabling thermal efficiency for heating fixing belt 112 to be improved.

The configuration of fixing unit 19 of the present invention is not limited to the above-described configurations, and application is also possible to both cases where exciting coil 120 is provided on the outer peripheral surface side of fixing belt 112 and cases where exciting coil 120 is provided on the inner peripheral surface side.

In an image heating apparatus according to Embodiment 6 of the present invention, a roller-shaped pressure roller 115 is used as a pressure member. However, it is also possible to implement this image heating apparatus using a configuration in which a fixing belt 112 rotational drive section is provided separately, the pressure member is in the form of a fixed bar-shaped pad, and recording paper 16 moving together with the rotation of fixing belt 112 is made to slide.

With this configuration, the area of the pressure member in contact with fixing belt 112 is smaller, and therefore the amount of heat absorbed by the pressure member is reduced. Consequently, with this image heating apparatus, the time until the temperature rises to the fixing temperature is shortened, and the temperature can be raised with little energy.

This application is based on Japanese Patent Application No. 2003-005692 filed on Jan. 14, 2003, the entire content of which is expressly incorporated by reference herein.

INDUSTRIAL APPLICABILITY

The present invention has an effect of enabling the calorific value distribution of a heat-producing member to be adjusted by adjusting magnetic flux acting upon the heat-producing member by means of a simple and inexpensive configuration, and is useful as an induction heating type of image heating apparatus in an image forming apparatus such as an electrophotographic apparatus or electrostatographic apparatus.

The invention claimed is:

1. An image heating apparatus comprising:

a rotatable heat-producing medium that produces heat by action of magnetic flux;

a magnetic flux generator positioned proximate to a portion of a first peripheral surface of said heat-producing medium and generates magnetic flux that acts upon said heat-producing medium;

a magnetic flux adjuster that is rotatably positioned on a second peripheral surface of said heat-producing medium, opposite the first peripheral surface, that has a paper passage area magnetic flux adjustment unit that causes a magnitude of magnetic flux acting upon a paper passage area of said heat-producing medium to vary depending upon whether the paper passage area magnetic flux adjustment unit is positioned close to and facing the magnetic flux generator or is positioned far from the magnetic flux generator, and a paper non-passage area magnetic flux adjustment unit that has a different rotational phase from said paper passage area magnetic flux adjustment unit and that causes a magnitude of magnetic flux acting upon a paper non-passage area of said heat-producing medium to vary depending upon whether the paper non-passage area magnetic flux adjustment unit is positioned close to and facing the magnetic flux generator or is positioned far from the magnetic flux generator, and that rotates during a fixing operation for each sheet of recording paper and periodically changes the magnitude of magnetic flux acting upon said heat producing medium at different timings between the paper passage area and the paper non-passage area; and a synchronization controller that periodically controls, for each sheet of recording paper, a timing of magnetic flux generation by said magnetic flux generator in synchronization with rotational phases of the magnetic flux adjustment units of said magnetic flux adjuster, wherein a calorific value distribution across a width of the heat-producing medium is adjusted by changing the timing of magnetic flux generation that is periodically controlled by the synchronization controller and by changing a spatial distribution of the magnetic flux acting upon the heat-producing medium.

2. The image heating apparatus according to claim 1, wherein a rotational speed of said magnetic flux adjuster is different from a rotational speed of said heat-producing medium.

3. The image heating apparatus according to claim 1, wherein said magnetic flux adjuster rotates an integral number of times while a predetermined part of said heat-producing medium passes through an area opposite said magnetic flux generator.

4. The image heating apparatus according to claim 1, wherein a direction of rotation of said magnetic flux adjuster is opposite to a direction of rotation of said heat-producing medium.

5. The image heating apparatus according to claim 1, wherein a downstream end of an area of said magnetic flux adjuster opposite said magnetic flux generator rotates at a speed greater than or equal to the speed of movement up to an upstream end on an opposite side while an arbitrary part of said heat-producing medium enters and passes through an area opposite said magnetic flux generator.

6. The image heating apparatus according to claim 1, wherein said magnetic flux adjuster has a configuration in which said paper passage area magnetic flux adjustment unit and said paper non-passage area magnetic flux adjustment unit are provided on a peripheral surface of a cylindrical body.

7. The image heating apparatus according to claim 6, wherein a plurality of said paper non-passage area magnetic flux adjustment units are located alternately in a circumferential direction of a center part and both end parts of a surface of said magnetic flux adjuster.

8. The image heating apparatus according to claim 6, wherein an upstream end of said paper non-passage area magnetic flux adjustment unit is positioned in a center part of said magnetic flux adjuster and downstream ends of said paper non-passage area magnetic flux adjustment unit are positioned at both ends of said magnetic flux adjuster.

9. The image heating apparatus according to claim 8, wherein a plurality of said paper non-passage area magnetic flux adjustment units are located alternately in a circumferential direction of a surface of said magnetic flux adjuster.

10. An image heating apparatus comprising:

a rotatable heat-producing medium that produces heat by action of magnetic flux;

a magnetic flux generator that is positioned proximate to a first peripheral surface of said heat-producing medium and generates magnetic flux that acts upon said heat-producing medium;

a temperature controller that controls said magnetic flux generator and maintains a temperature of a surface of said heat-producing medium at a predetermined temperature; and a calorific value distribution adjuster that selectively adjusts magnetic flux acting upon a predetermined area of said heat-producing medium and equalizes a calorific value distribution of said heat-producing medium;

wherein said calorific value distribution adjuster has an electrical conductor opposite said magnetic flux generator.

11. An image heating apparatus comprising:

a rotatable heat-producing medium that produces heat by action of magnetic flux;

a magnetic flux generator that is positioned proximate to a first peripheral surface of said heat-producing medium and generates magnetic flux that acts upon said heat-producing medium;

a temperature controller that controls said magnetic flux generator and maintains a temperature of a surface of said heat-producing medium at a predetermined temperature; and a calorific value distribution adjuster that selectively adjusts magnetic flux acting upon a predetermined area of said heat-producing medium and equalizes a calorific value distribution of said heat-producing medium;

wherein said calorific value distribution adjuster includes a suppression member that is linked to magnetic flux generated by said magnetic flux generator.

12. An image forming apparatus comprising:

the image heating apparatus according to claim 1;

a first temperature sensor that detects a temperature of a paper passage area of said heat-producing medium and sends a heat-producing medium paper passage area detected temperature signal to said synchronization controller; and a second temperature sensor that detects a temperature of a paper non-passage area of said heat-producing medium and sends a heat-producing medium paper non-passage area detected temperature signal to said synchronization controller;

wherein said synchronization controller controls a timing of magnetic flux generation by said magnetic flux generator in synchronization with respective rotational phases of the magnetic flux adjustment units of said magnetic flux adjuster based on a detected temperature signal from said second temperature sensor.

13. An image forming apparatus comprising:

an image heating apparatus comprising:

a rotatable heat-producing medium that produces heat by action of magnetic flux;

a magnetic flux generator that is positioned proximate to a first peripheral surface of said heat-producing medium and generates magnetic flux that acts upon said heat-producing medium;

a temperature controller that controls said magnetic flux generator and maintains a temperature of a surface of said heat-producing medium at a predetermined temperature; and a calorific value distribution adjuster that selectively adjusts magnetic flux acting upon a predetermined area of said heat-producing medium and equalizes a calorific value distribution of said heat-producing medium;

wherein said calorific value distribution adjuster has a magnetic body opposite said magnetic flux generator;

a first temperature sensor that detects a temperature of a paper passage area of said heat-producing medium and sends a heat-producing medium paper passage area detected temperature signal to said temperature controller; and a second temperature sensor that detects a temperature of a paper non-passage area of said heat-producing medium and sends a heat-producing medium paper non-passage area detected temperature signal to said temperature controller;

wherein said calorific value distribution adjuster selectively adjusts magnetic flux acting upon a predetermined area of said heat-producing medium and equalizes a calorific value distribution of said heat-producing medium based on a detected temperature signal from said second temperature sensor.

14. An image forming apparatus comprising:

an image heating apparatus comprising:

a rotatable heat-producing medium that produces heat by action of magnetic flux;

a magnetic flux generator that is positioned proximate to a first peripheral surface of said heat-producing medium and generates magnetic flux that acts upon said heat-producing medium;

a temperature controller that controls said magnetic flux generator and maintains a temperature of a surface of said heat-producing medium at a predetermined temperature; and a calorific value distribution adjuster that selectively adjusts magnetic flux acting upon a predetermined area of said heat-producing medium and equalizes a calorific value distribution of said heat-producing medium;

wherein said calorific value distribution adjuster has a magnetic body opposite said magnetic flux generator;

a rotatable pressure member that applies pressure to said heat-producing medium;

a first pressure member temperature sensor that detects a temperature of a paper passage area of said pressure member and sends a pressure member paper passage area detected temperature signal to said temperature controller; and a second pressure member temperature sensor that detects a temperature of a paper non-passage area of said pressure member and sends a pressure member paper non-passage area detected temperature signal to said temperature controller;

wherein said calorific value distribution adjuster selectively adjusts a magnetic flux acting upon a predetermined area of said heat-producing medium and equalizes a calorific value distribution of said heat-producing medium based on a detected temperature signal from said second pressure temperature sensor.

15. An image heating apparatus comprising:

a rotatable heat-producing element configured to produce heat by action of a magnetic flux;

a magnetic flux generator positioned proximate to a part of a first peripheral portion of said heat-producing element and configured to generate magnetic flux that acts upon said heat-producing element;

a rotatable magnetic flux adjuster that is positioned on a second peripheral portion of said heat-producing element, opposite the first peripheral portion, that has a recording medium passage area magnetic flux adjustment unit that causes a magnitude of magnetic flux acting upon a recording medium passage area of said heat-producing element to vary depending on whether the recording medium passage area magnetic flux adjustment unit is positioned close to and facing the magnetic flux generator or is positioned far from the magnetic flux generator, and a recording medium non-passage area magnetic flux adjustment unit that has a different rotational phase from said recording medium passage area magnetic flux adjustment unit and that causes a magnitude of a magnetic flux acting on a recording medium non-passage area of said heat-producing medium to vary depending on whether the recording medium non-passage area magnetic flux adjustment unit is positioned close to and facing the magnetic flux adjustment unit or is positioned far from the magnetic flux generator, and that rotates during a fixing operation for each sheet of recording medium and periodically changes the magnitude of magnetic flux acting on said heat producing element at different timings between the recording medium passage area and the recording medium non-passage area; and a synchronization controller that periodically controls, for each sheet of recording medium, a timing of magnetic flux generation by said magnetic flux generator in synchronization with rotational phases of the magnetic flux adjustment units of said magnetic flux adjuster, wherein a calorific value distribution across a width of the heat-producing element is adjusted by changing the timing of magnetic flux generation that is periodically controlled by the synchronization controller and by changing a spatial distribution of the magnetic flux acting upon the heat-producing element.

16. The image heating apparatus according to claim 15, wherein said recording medium passage area magnetic flux adjustment unit and said recording medium non-passage area magnetic flux adjustment unit comprise peripheral surfaces of a cylindrical body.

17. The image heating apparatus according to claim 15, further comprising at least one temperature sensor positioned to detect a temperature of a recording medium passage area of said heat-producing element, wherein said synchronization controller controls a timing of magnetic flux generation by said magnetic flux generator in synchronization with respective rotational phases of the magnetic flux adjustment units of said magnetic flux adjustor based on a temperature detected by said at least one temperature sensor.

18. The image heating apparatus according to claim 15, wherein a direction of rotation of said magnetic flux adjuster is opposite to a direction of rotation of said heat-producing element.

19. An image forming apparatus comprising:

the image heating apparatus according to claim 10;

a first temperature sensor that detects a temperature of a paper passage area of said heat-producing medium and sends a heat-producing medium paper passage area detected temperature signal to said temperature controller; and a second temperature sensor that detects a temperature of a paper non-passage area of said heat-producing medium and sends a heat-producing medium paper non-passage area detected temperature signal to said temperature controller;

wherein said calorific value distribution adjuster selectively adjusts magnetic flux acting upon a predetermined area of said heat-producing medium and equalizes a calorific value distribution of said heat-producing medium based on a detected temperature signal from said second temperature sensor.

20. An image forming apparatus comprising:

the image heating apparatus according to claim 11;

a first temperature sensor that detects a temperature of a paper passage area of said heat-producing medium and sends a heat-producing medium paper passage area detected temperature signal to said temperature controller; and a second temperature sensor that detects a temperature of a paper non-passage area of said heat-producing medium and sends a heat-producing medium paper non-passage area detected temperature signal to said temperature controller;

wherein said calorific value distribution adjuster selectively adjusts magnetic flux acting upon a predetermined area of said heat-producing medium and equalizes a calorific value distribution of said heat-producing medium based on a detected temperature signal from said second temperature sensor.

21. An image forming apparatus comprising:

the image heating apparatus according to claim 10;

a rotatable pressure member that applies pressure to said heat-producing medium;

a first pressure member temperature sensor that detects a temperature of a paper passage area of said pressure member and sends a pressure member paper passage area detected temperature signal to said temperature controller; and a second pressure member temperature sensor that detects a temperature of a paper non-passage area of said pressure member and sends a pressure member paper non-passage area detected temperature signal to said temperature controller;

wherein said calorific value distribution adjuster selectively adjusts a magnetic flux acting upon a predetermined area of said heat-producing medium and equalizes a calorific value distribution of said heat-producing medium based on a detected temperature signal from said second pressure temperature sensor.

22. An image forming apparatus comprising:

the image heating apparatus according to claim 11;

a rotatable pressure member that applies pressure to said heat-producing medium;

a first pressure member temperature sensor that detects a temperature of a paper passage area of said pressure member and sends a pressure member paper passage area detected temperature signal to said temperature controller; and a second pressure member temperature sensor that detects a temperature of a paper non-passage area of said pressure member and sends a pressure member paper non-passage area detected temperature signal to said temperature controller;

wherein said calorific value distribution adjuster selectively adjusts a magnetic flux acting upon a predetermined area of said heat-producing medium and equalizes a calorific value distribution of said heat-producing medium based on a detected temperature signal from said second pressure temperature sensor.

23. The image heating apparatus according to claim 10, the rotatable heat producing medium comprising a ring-shaped or belt-shaped member.

24. The image heating apparatus according to claim 11, the rotatable heat producing medium comprising a ring-shaped or belt-shaped member.

* * * * *